US005469801A

United States Patent [19]

Payne

[11] Patent Number: 5,469,801

[45] Date of Patent: Nov. 28, 1995

[54] ADVANCED MARINE VEHICLES FOR OPERATION AT HIGH SPEED IN OR ABOVE ROUGH WATER

[75] Inventor: Peter R. Payne, Severna Park, Md.

[73] Assignee: Dynafoils, Inc., Severna Park, Md.

[21] Appl. No.: 63,782

[22] Filed: May 19, 1993

Related U.S. Application Data

[63] Continuation-in-part of Ser. No. 810,869, Dec. 20, 1991, Pat. No. 5,311,832 which is a continuation-in-part of PCT/US92/10774, Dec. 18, 1992.

[51] Int. Cl.[6] ..... B63B 1/30

[52] U.S. Cl. ..... 114/282; 114/280; 114/274

[58] Field of Search ..... 440/66–69, 47, 440/38; 114/274–282, 151, 67 R, 67 A, 65 A; D12/309

[56] References Cited

U.S. PATENT DOCUMENTS

| | | | |
|---|---|---|---|
| 796,846 | 8/1905 | de Lambert | 114/274 |
| 1,107,260 | 8/1914 | Burney | 114/274 |
| 1,301,917 | 4/1919 | de Bolotoff | 114/282 |
| 1,752,406 | 4/1930 | Wetch | 114/279 |
| 1,818,309 | 8/1931 | De Villard | 114/274 |
| 1,878,775 | 9/1932 | Henry | 114/275 |
| 2,603,179 | 7/1952 | Gardiner | 114/279 |
| 2,749,870 | 6/1956 | Vavra | 114/274 |
| 2,771,051 | 11/1956 | von Schertel | 114/280 |
| 2,930,338 | 3/1960 | Flomenhoft | 114/274 |
| 3,044,432 | 7/1962 | Wennagel et al. | 114/274 |
| 3,104,642 | 9/1963 | Piazza | 114/279 |
| 3,141,437 | 7/1964 | Bush et al. | 114/280 |
| 3,183,871 | 5/1965 | Reder | 114/66.5 |
| 3,199,484 | 8/1965 | Wiberg | 114/280 |
| 3,236,202 | 2/1966 | Quady et al. | 114/280 |
| 3,270,699 | 9/1966 | Bush | 114/66.5 |
| 3,324,815 | 6/1967 | Morales | 114/66.5 |
| 3,354,857 | 11/1967 | Hobday | 114/282 |
| 3,417,722 | 12/1968 | O'Neill | 114/279 |
| 3,456,611 | 7/1969 | Johnson | 114/274 |
| 3,459,146 | 8/1969 | Prior | 114/280 |
| 3,499,412 | 3/1970 | Anthes et al. | 115/42 |
| 3,547,063 | 12/1970 | Follett | 114/274 |
| 3,710,747 | 1/1973 | Guidi | 114/274 |
| 3,722,450 | 3/1973 | Arimura | 114/274 |
| 3,760,756 | 9/1973 | Boden | 114/274 |
| 3,762,355 | 10/1973 | Raynes . | |
| 3,763,810 | 10/1973 | Payne | 114/56 |
| 3,797,434 | 3/1974 | Matthews . | |
| 3,812,806 | 5/1974 | Kortkov et al. . | |
| 3,897,744 | 8/1975 | Lang | 114/61 |

(List continued on next page.)

FOREIGN PATENT DOCUMENTS

| | | | |
|---|---|---|---|
| 863288 | 1/1941 | France . | |
| 1272736 | 8/1961 | France . | |
| 768045 | 6/1955 | Germany . | |
| 1193821 | 5/1965 | Germany . | |
| 619232 | 3/1961 | Italy | 114/279 |
| 150392 | 2/1984 | Norway . | |
| 572413 | 10/1945 | United Kingdom . | |
| 745821 | 3/1956 | United Kingdom | 114/280 |
| 8401137 | 3/1984 | WIPO . | |

OTHER PUBLICATIONS

William M. Ellsworth, AIAA/SNAME Advanced Marine Vehicles Conf., AIAA/SNAME Advanced Marine Vehicles Conf., AIAA Paper #74–306, San Diego, Calif. 1974.

*Primary Examiner*—Edwin L. Swinehart
*Attorney, Agent, or Firm*—Leydig, Voit & Mayer

[57] ABSTRACT

A hydrofoil craft has a hull supported above a water surface by a foil connected to the hull by means of a support arm. In accordance with one form of the invention, the support arm enables the foil to move up and down with respect to the hull in concert with upgusts and downgusts of water surrounding the foil so as to maintain the hull at an approximately constant elevation. In accordance with another form of the invention, the support arm is supported by the hull for pivoting about a longitudinal axis extending in substantially the fore and aft direction of the hull. When rolling forces act on the foil, the support arm can pivot about the axis from a vertical position in response to the rolling forces while enabling the hull to remain substantially level.

62 Claims, 16 Drawing Sheets

U.S. PATENT DOCUMENTS

| | | | |
|---|---|---|---|
| 3,949,695 | 4/1976 | Pless . | |
| 3,977,348 | 8/1976 | Bordat et al. . | |
| 4,304,558 | 12/1981 | Holtermann | 440/67 |
| 4,579,076 | 4/1986 | Chaumette . | |
| 4,606,291 | 8/1986 | Hoppe . | |
| 4,649,851 | 3/1987 | April | 114/271 |
| 4,665,853 | 5/1987 | Gerdsen et al. | 114/61 |
| 4,748,929 | 6/1988 | Payne | 114/280 |
| 4,832,570 | 5/1989 | Solia | 440/67 |
| 4,857,026 | 8/1989 | Hull | 441/65 |
| 4,896,621 | 1/1990 | Coles . | |
| 4,926,773 | 5/1990 | Manor . | |
| 4,929,200 | 5/1990 | Guezou et al. | 440/47 |
| 4,949,919 | 8/1990 | Wajnikonis . | |
| 4,955,312 | 9/1990 | Magazzu | 114/280 |
| 5,171,175 | 12/1992 | Buzzi | 440/66 |

FIG. 5
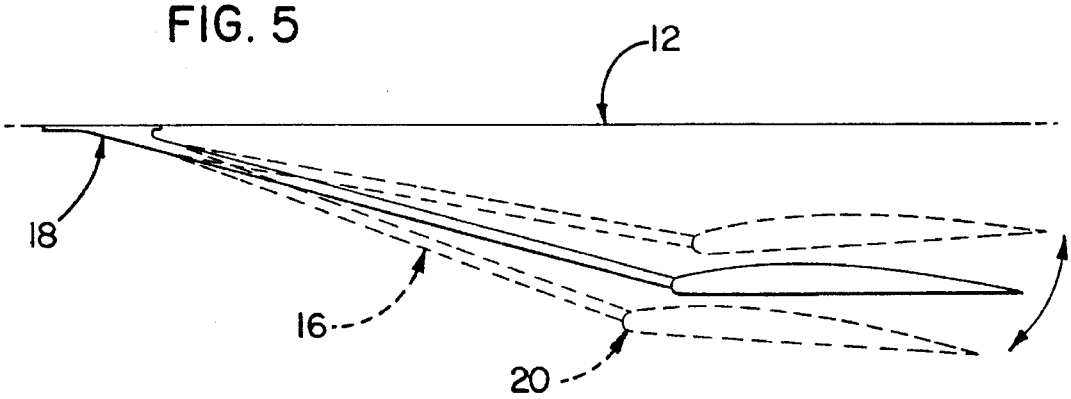
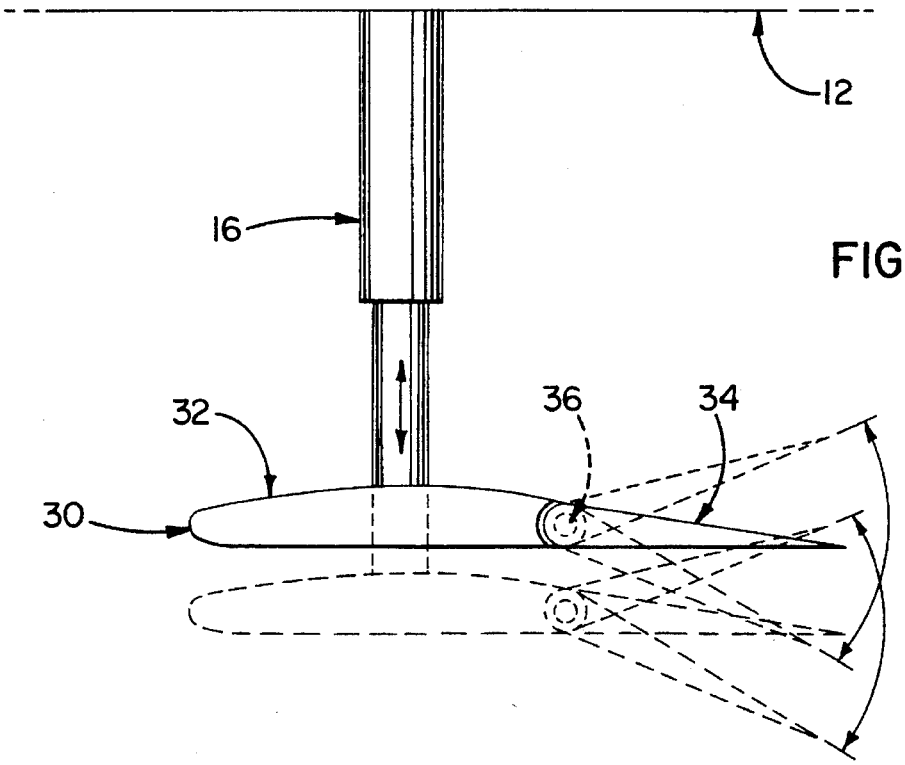
FIG. 6

FIG. 7
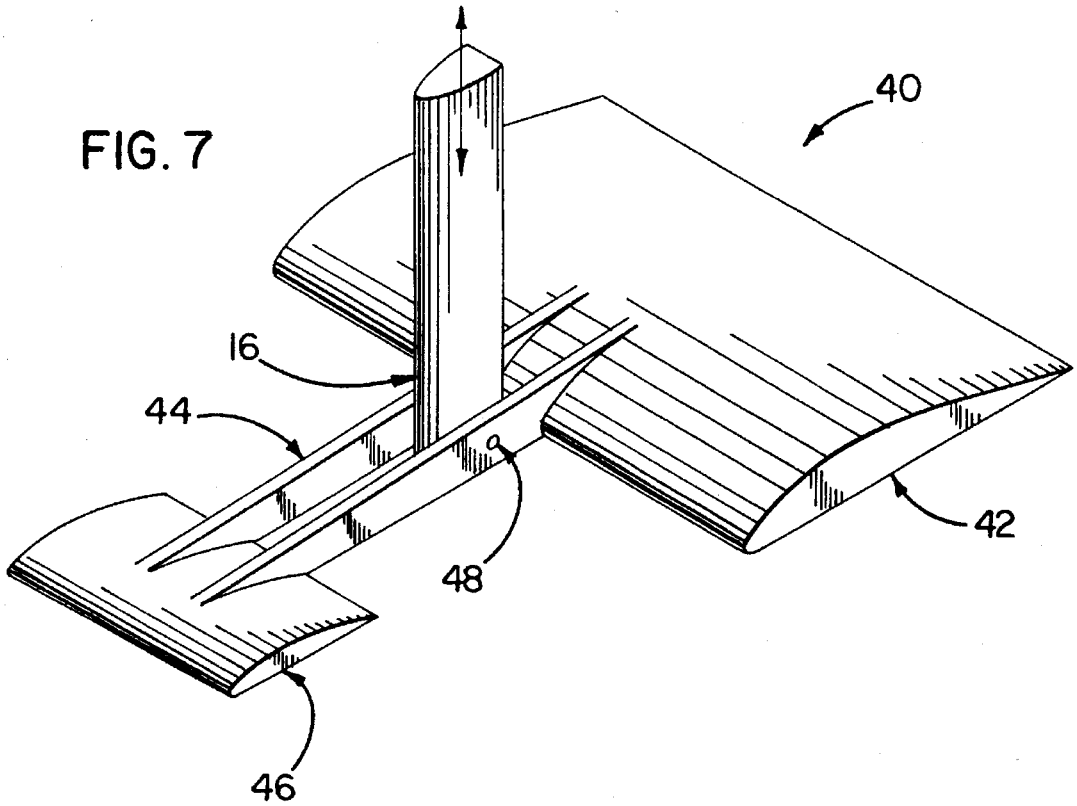
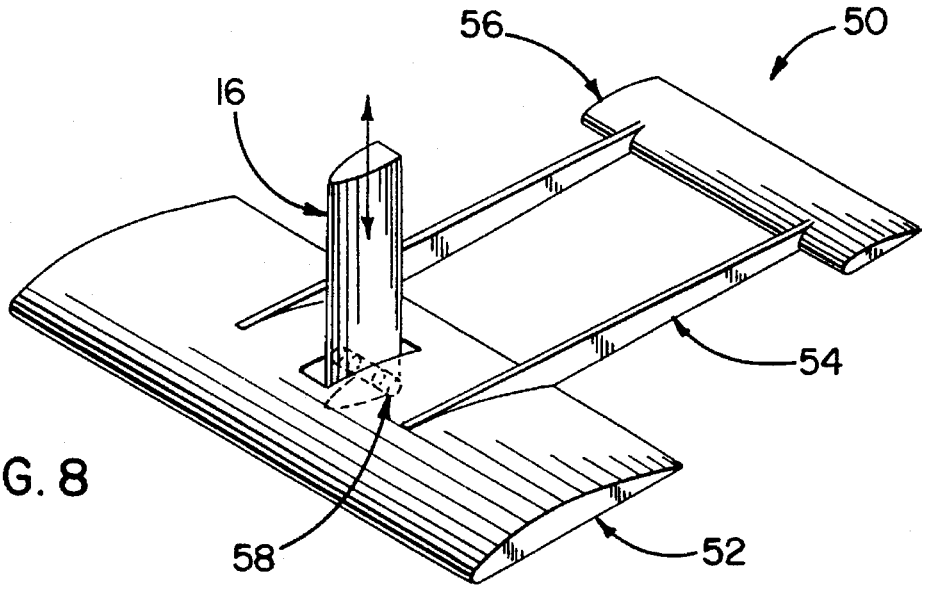
FIG. 8

FIG. 16a
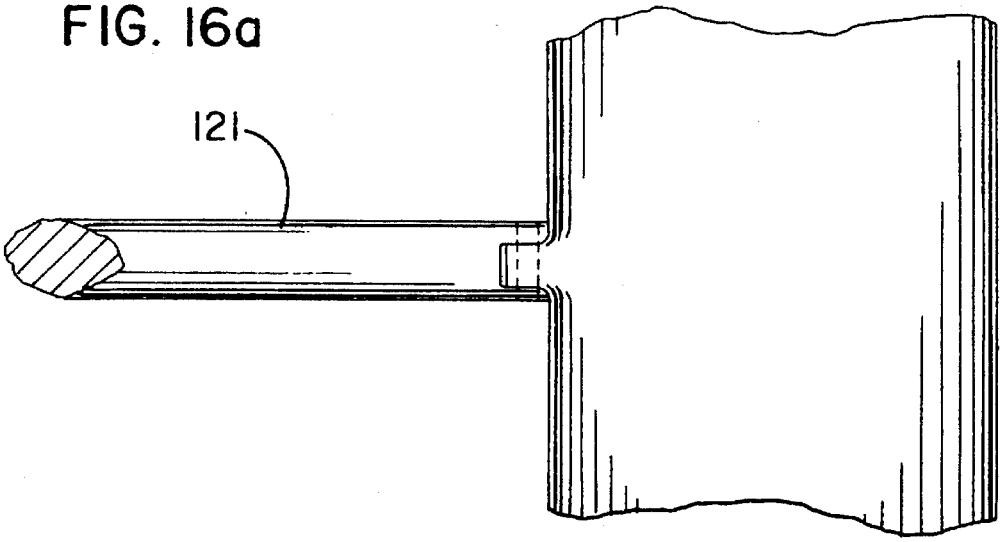
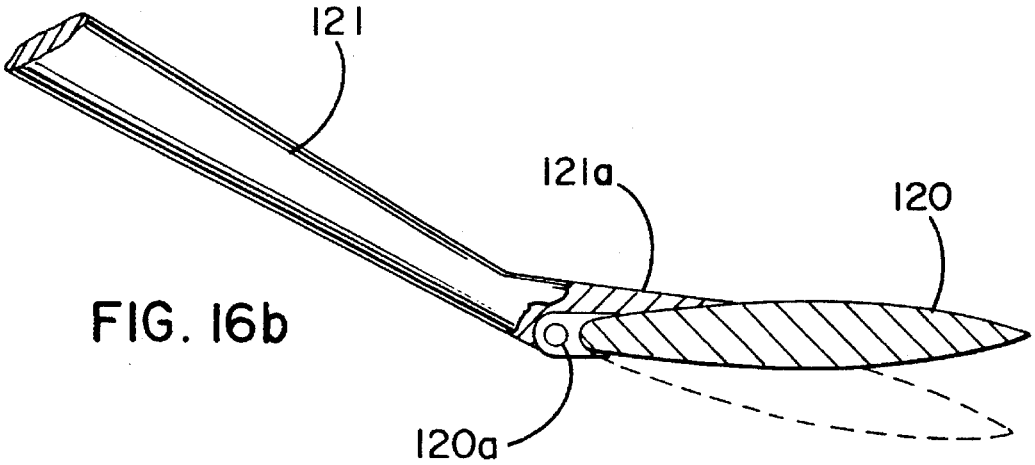
FIG. 16b
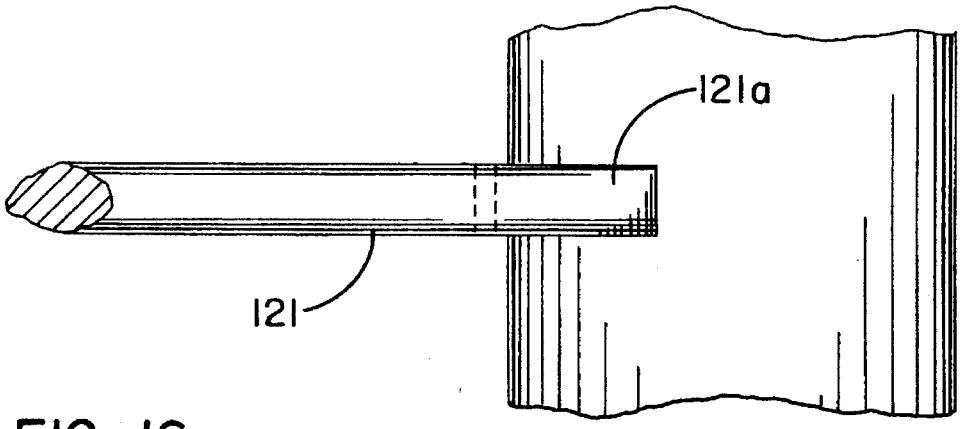
FIG. 16c

ADVANCED MARINE VEHICLES FOR OPERATION AT HIGH SPEED IN OR ABOVE ROUGH WATER

This application is a CIP of U.S. Ser. No. 07/810,869, filed Dec. 20, 1991, now U.S. Pat. No. 5,311,832 which is a continuation-in-part of PCT/US92/10774, Dec. 12, 1992.

FIELD OF THE INVENTION

The present invention relates generally to advanced marine vehicles ("AMV") and, specifically, to hydrofoil craft and wing in ground effect ("WIG") aircraft which are capable of being operated at high speeds in or above rough water.

BACKGROUND OF THE INVENTION

Dynamically supported AMVs cannot be operated comfortably at high speeds in or above rough water. Examples of such AMVs include air cushion vehicles, surface effect ships, wing in ground effect ("WIG") aircraft, and hydrofoil craft.

Hydrofoil craft are boats which typically possess a more or less conventional planing boat hull and which have one or more vertical struts extending from beneath the hull into the water. Each vertical strut typically carries at least one foil. When the hydrofoil craft has accelerated to a sufficient velocity through the water, the lift created by the foils raises the hull above the water's surface, thus eliminating the hull's resistance.

WIG aircraft, in contrast, are "flying boats" intended to cruise just above wave crests so as to avoid all but very occasional water contact during flight. WIG aircraft possess one or more wings which are generally three orders of magnitude larger than the foils of hydrofoil craft. When a WIG aircraft has accelerated to a sufficient velocity through the water, the aerodynamic lift created by these wings lifts the aircraft entirely out of the water. By remaining close to the water's surface, WIG aircraft encounter significantly less resistance than they would encounter at higher altitudes because their aerodynamic lift is much greater closer to the water's surface than it would be at higher altitudes.

Hydrofoil craft are often used to transport people and cargo across varying sea states. However, hydrofoil craft are typically used in rough water only at reduced speeds, because of their uncomfortable motions and becuase their foils occasionally loose lift entirely, causing their hulls to crash into the water. WIG aircraft have not yet been built commercially.

To determine how a hydrofoil craft could be operated at high speeds in rough waters without resulting in an uncomfortable ride, I engaged in a "time-domain analysis" in which the actual forces on a craft were calculated at successive time intervals. From these calculation, the craft's motion in space could be determined.

I performed a time-domain computer analysis to reconstruct the detailed shape of a random sea's surface (i.e., the random wave patterns), as a function of both time and space. The real random seas which are actually experienced can be thought of as the sum of many sinusoidal component waves where each individual wave component has its own orbital velocity. A reconstruction of such a random sea was obtained by using wave components of equal energy rather than wave components of equal frequency in the method described in *Principles of Naval Architecture*, Society of Naval and Marine Engineers, Chp. 8 (1990). The resulting random seaway was found to follow the statistical theories postulated in Cartwright, D. E., and Longuet-Higgins, M. S., "The Statistical Distribution of the Maxima of a Random Function," *Proc., Roy. Soc.*, Ser. A, Vol. 237, pp. 212–232 (1956).

Once realistic random seas could be computed, the water's movement and velocity below the water's surface could be studied. During this study, I discovered that the velocity of water in a seaway typically approximated the expected value for a sinusoidal wave train of the same average wave height and length. Periodically, however, the individual wave components would combine such that the aggregation of the components would result in much more or much less vertical velocity than would be the case for a single sinusoidal wave.

I believe that these occasionally extreme changes in vertical water velocity are at least partially responsible for the uncomfortable and sometimes injurious rides to which hydrofoil craft are subject in rough water, particularly when the occasionally extreme change in water velocity is a "downgust". When a foil is moving horizontally in the water and encounters such a downgust, the effect of this downgust, from the foil's point of view, is the same as if the foil were lifted rapidly upward. In either case, the "added mass" of the water in the vicinity of the foil imposes a large downward acting load on the foil.

The concept of "added mass" has been known to hydrodynamicists for at least two centuries, but is not well understood by most engineers. I have described the phenomenon in some detail in the first and second chapters of my book "Design of High Speed Boats: Volume 1, Planing", published by Fishergate, Inc., 2521 Riva Road, Annapolis, Md 21401.

Roughly speaking, a submerged body (such as a foil) moving through the water displaces the water locally by its passage. The water is moved aside as the foil pushes by, and then more or less returns to where it was after the foil has passed. If the foil is moving at a constant speed, this movement of the water in its vicinity does not cause any resistance to the foil's motion. The resistance which does exist is due to the water's viscosity.

When the foil is accelerating to higher speeds, however, this moving aside of the water provides additional resistance to the acceleration, and so we call this effect "added mass". A given propulsive force causes the foil to accelerate less rapidly in water than it would in air, because of this added mass which is three orders of magnitude greater in water than in air because of water's much greater density. Conversely, the hydrodynamic force exerted on a foil, if the water is accelerating, is larger than its constant speed resistance.

Very roughly, the "added mass" of a high aspect ratio body like a foil is equal to the mass of water in a circular cylinder whose length is equal to the foil's span and whose diameter is equal to the foil's thickness or breadth measured at right angles to its direction of motion. Thus, if a foil has a span of ten feet, a chord of four feet and a thickness of 0.3 feet, its added mass for motion parallel to its chord will be about $$\left[\left[\frac{0.3}{2}\right]^2 \pi \cdot 10\right] \cdot 2 = 1.41 \text{ slugs (45.5 pounds)}$$

If, on the otherhand, its motion is at right angles to the chord, its added mass will be about $$\left[\left[\frac{4}{2}\right]^2 \pi \cdot 10\right] \cdot 2 = 251.3 \text{ slugs (8,088 pounds)}$$

Thus, although the "added mass" is not important for a foil's normal motion roughly parallel to its chord, it has a powerful effect on any vertical motion which may be superimposed on this generally horizontal motion. The added mass resists upward and downward acceleration of the foil. Conversely, if the water is accelerating vertically at ten feet per second per second (ft/sec$^2$), the vertical force on the foil, due to "added mass" alone, will be about 251.3×10=2,513 pounds (mass)×(acceleration)=(force)

Notice that this effect has nothing to do with the foil's angle of attack to the relative flow of water, so that it is not significantly influenced by changing the foil's angle to the flow.

Accordingly, when a hydrofoil craft encounters a downgust and tries to compensate for this downgust by changing the angle of incidence of its foils to increase lift, this compensation by itself is not sufficient to overcome the substantial downward impulse due to the water's added mass. In other words, merely changing the angle of incidence of the foil will not prevent a downgust of water from forcing the foil farther below the water's surface than it was prior to encountering the downgust. When the foil is attached to a conventional vertical strut which is rigid, the downgust of water will necessarily lower the hydrofoil craft's hull as well as the foil. If the downgust of water is sufficiently large, the craft's hull can be lowered enough so that the hull will impact the water's surface ("plough-in"), which is uncomfortable and occasionally dangerous.

U.S. Pat. Nos. 3,417,722 (O'Neill), 2,771,051 (Von Schertel) and 3,141,437 (Bush et al.) are examples of previous efforts made in an attempt to create a hydrofoil craft which could operate at higher speeds in rough water. However, these three patents tried to solve this problem by merely changing the foil's angle of incidence to compensate for any changes in the orbital velocity of waves. As alluded to previously, these attempts were unsuccessful because they did not take into account the "added mass" effect of the vertically moving water. Furthermore, merely "changing the [foil's angle of incidence] in an attempt to maintain an essentially constant angle of attack in waves is a self-defeating process [because] the inherent lags in the total system make this a practical impossibility." Ellsworth, W., "Hydrofoil Development—Issues and Answers," A1AA/SNAME Advanced Marine Vehicle Conference, Paper No. 74-306 (1974).

U.S. Pat. Nos. 3,456,611 (Johnson) and 2,930,338 (Flomenhoft) also attempted to create a smooth-riding hydrofoil craft by attaching springs or cylinders to the vertical struts of hydrofoils. However, neither of these patents addresses the problem created by the added mass effect. Johnson employs his vertical struts as "equalizers" (to stabilize the craft) and shock absorbers, while Flomenhoft uses his struts for "better cushioning." Thus, it has proven extremely difficult to devise a hydrofoil craft which can compensate for the "added mass" effect of water so as to enable it to operate at high speeds in rough water.

Accordingly, there remains a need in the art for hydrofoil craft which can compensate for the random upgusts and downgusts of water velocity around its foils and which can maintain approximately constant lift so that the hull above the foils can ride smoothly at high speed in rough water. Furthermore, there also remains a need in the art for WIG aircraft which can compensate for the random changes in the lift of its wings so that the aircraft can fly comfortably just above the water's surface.

SUMMARY OF THE INVENTION

The present invention provides a hydrofoil craft which can compensate for the random upgusts and downgusts of water around its foils, which can operate at high speeds in rough water, and which can maintain approximately constant lift.

The present invention additionally provides a hydrofoil which can attenuate rolling motion.

The present invention further provides a WIG aircraft which can compensate for the random changes in the lift of its wings and which can operate smoothly and efficiently close to the water's surface.

According to one form of the present invention, a hydrofoil craft includes a hull and a support arm supported by the hull for pivoting about an axis extending transversely with respect to a centerline plane of the hull. A foil is disposed beneath the hull for supporting the hull above a water surface and connected to the support arm such that an angle of incidence of the foil varies as the support arm pivots about the axis. Biasing means are provided for biasing the support arm to pivot away from the hull. With this arrangement, the foil can move with respect to the hull in concert with upgusts and downgusts or water surrounding the foil and thereby reduce the accelerations imparted to the hull by the upgusts and downgusts. Preferably, the biasing means permits movement of the foil by approximately the maximum height of waves in which the craft is designed to operate.

In accordance with another aspect of the present invention, a hydrofoil craft includes a hull, a foil for supporting the hull above a water surface, and a support arm connected to the foil and connected to the hull for pivoting from a center position about a first axis extending in generally a fore and aft direction of the hull. This arrangement enables the foil and the support arm to move in response to rolling forces acting on the foil while enabling the hull to remain substantially level without undergoing rolling motions, thereby increasing the comfort of the ride.

In accordance with yet another aspect of the present invention, a WIG aircraft comprises a fuselage, at least one support arm extending from the fuselage, means for connecting the support arm to the fuselage, and at least one wing attached to at least one support arm so that the support arms and the wings move in concert with the changes in the lift of its wings so as to enable the wings to maintain approximately constant lift.

BRIEF DESCRIPTION OF THE DRAWINGS

FIG. 5 is a schematic view depicting the way in which flexible support arms move in concert with the changes in water velocity around the foils.

FIG. 6 is a side elevational view depicting a foil with a hinged flap.

FIG. 7 is a perspective view depicting a canard tandem foil arrangement which is stabilized by the forward foil.

FIG. 8 is a perspective view depicting a tandem foil arrangement which is stabilized by the aft foil.

FIGS. 16*a*–16*c* are views of a main foil that can be used in the embodiment of FIG. 12.

DESCRIPTION OF THE PREFERRED EMBODIMENTS

Figure 1:
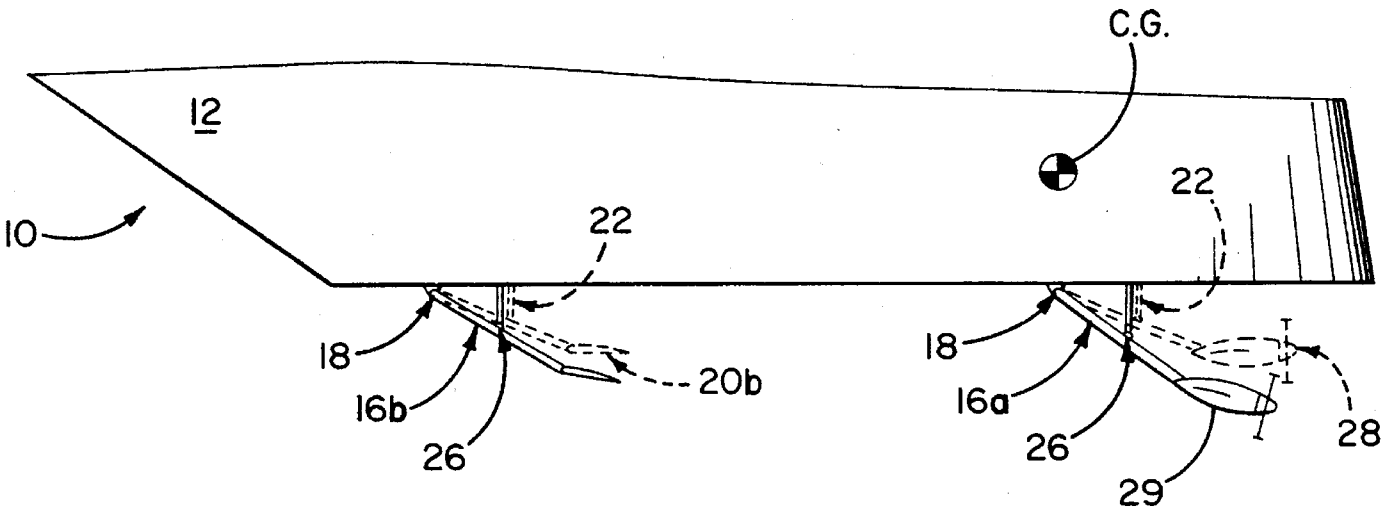
FIG. 1 is a side elevational, partially schematic view showing the unique hydrofoil craft of the present invention with means for allowing the foils to move in concert with the upgusts and downgusts of water velocity around the foils.
Figure 2:
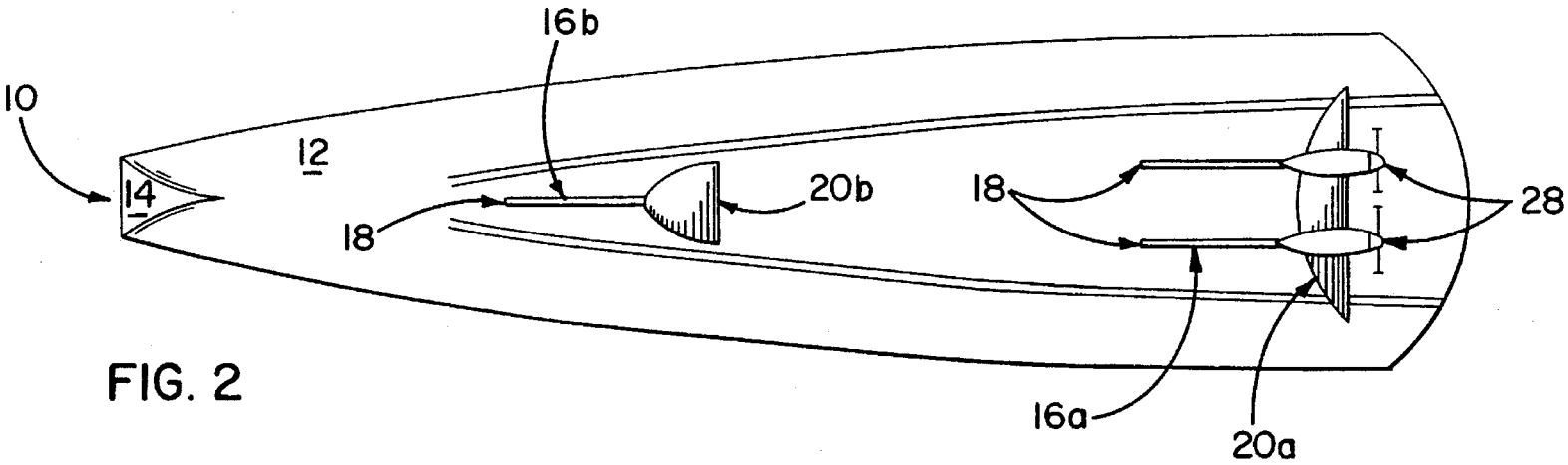
FIG. 2 is a bottom plan view showing the unique hydrofoil craft of the present invention.

FIGS. 1 and 2 schematically illustrate a unique hydrofoil craft 10 according to the present invention which is capable of operating at high speeds in rough water. The hydrofoil craft 10 has at least one hull 12 of a desired configuration. Preferably, the hull 12 possesses a configuration which enables the hull 12 to cut through the higher waves of a rough sea without experiencing large accelerations. An example of such a hull configuration is disclosed in my prior U.S. Pat. No. 3,763,810, incorporated herein by reference. The hull's slender configuration reduces the dynamic lift of the hull 12 when in contact with the water. Accordingly, the reduced plan area of the forward sections of the hull 12 minimizes dynamic lift forces during wave impacts, thus reducing both drag and vertical acceleration. A transom 14 can be incorporated in the bow of the hull 12. The bow transom 14 helps to prevent complete bow submergence during severe wave impacts as taught in my prior patent.

Figure 3:
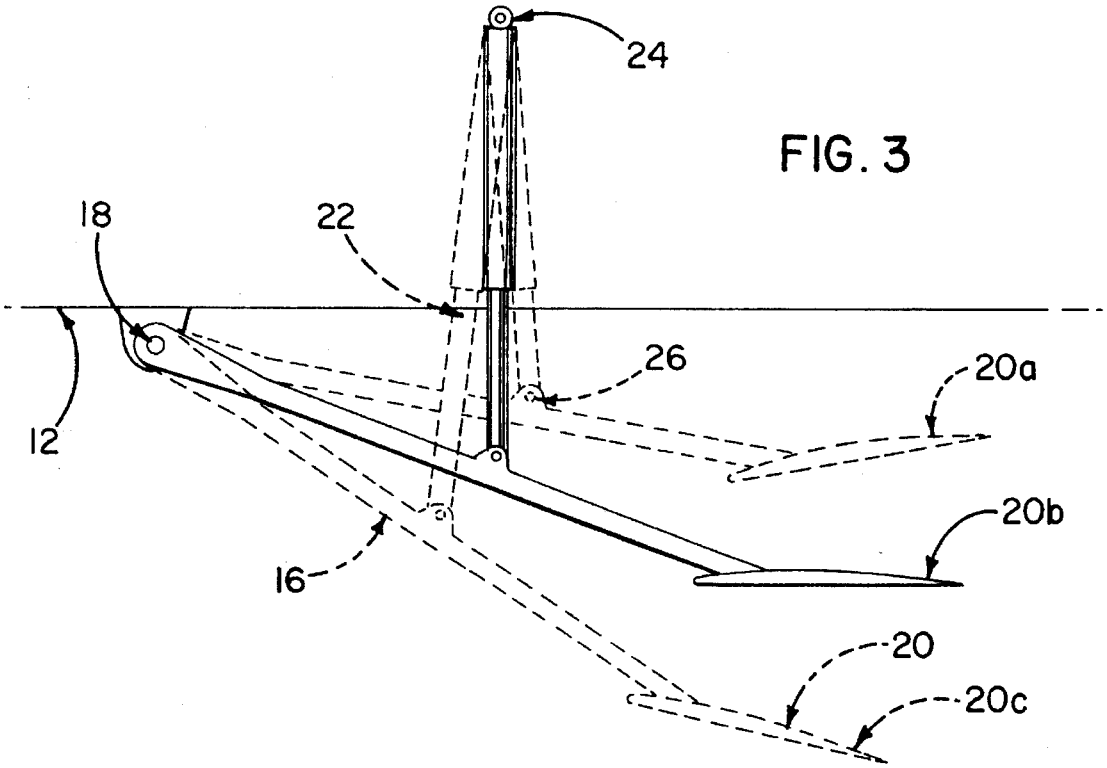
FIG. 3 is a schematic view illustrating the way in which support arms which extend angularly downward from the hull of the hydrofoil craft move in concert with the upgusts and downgusts of water velocity around the foils.
Figure 4:
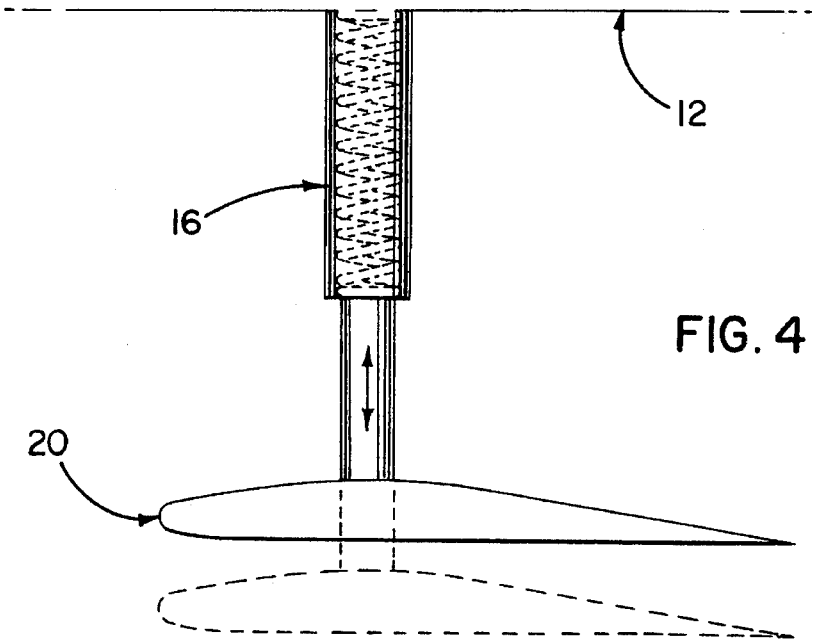
FIG. 4 is a schematic view showing the way in which support arms which extend vertically downward move in concert with the changes in water velocity around the foils.

In the present invention, at least one support arm 16 is attached to the hull 12, preferably at or near the bottom. The support arms 16 are attached so that they extend downward from the plane of the bottom of the hull 12 into the water. Preferably, the support arms 16 extend angularly downward from the hull 12 into the water, as is shown in FIG. 3. However, the support arms 16 can also extend vertically downward from the hull 12 into the water, as is shown in FIG. 4, the vertical motion being obtained by a telescoping mechanism. Preferably, at least two support arms 16 are attached to the hull 12, with one support arm 16 located toward the rear of the hull 12 and another support arm 16 located toward the forward portion of the hull 12.

Each support arm 16 is attached at or near the bottom of the hull 12 at an attachment or connection 18. Attachment of each support arm 16 at or near the bottom of the hull 12 can be either pivotal or rigid. Where the attachment or connection 18 is rigid, each support arm 16 can be at least partially flexible. That is, each support arm 16 can be either uniformly flexible so that the support arm 16 bends throughout its entire length or only partially flexible (e.g., the support arm 16 can be rigid except near the attachment or connection 18 where the support arms 16 are thinner so as to allow the support arm 16 to bend only at this thin section), as is shown in FIG. 5. These flexible support arms can be made of any resilient material, such as fiberglass or steel.

Figure 11:
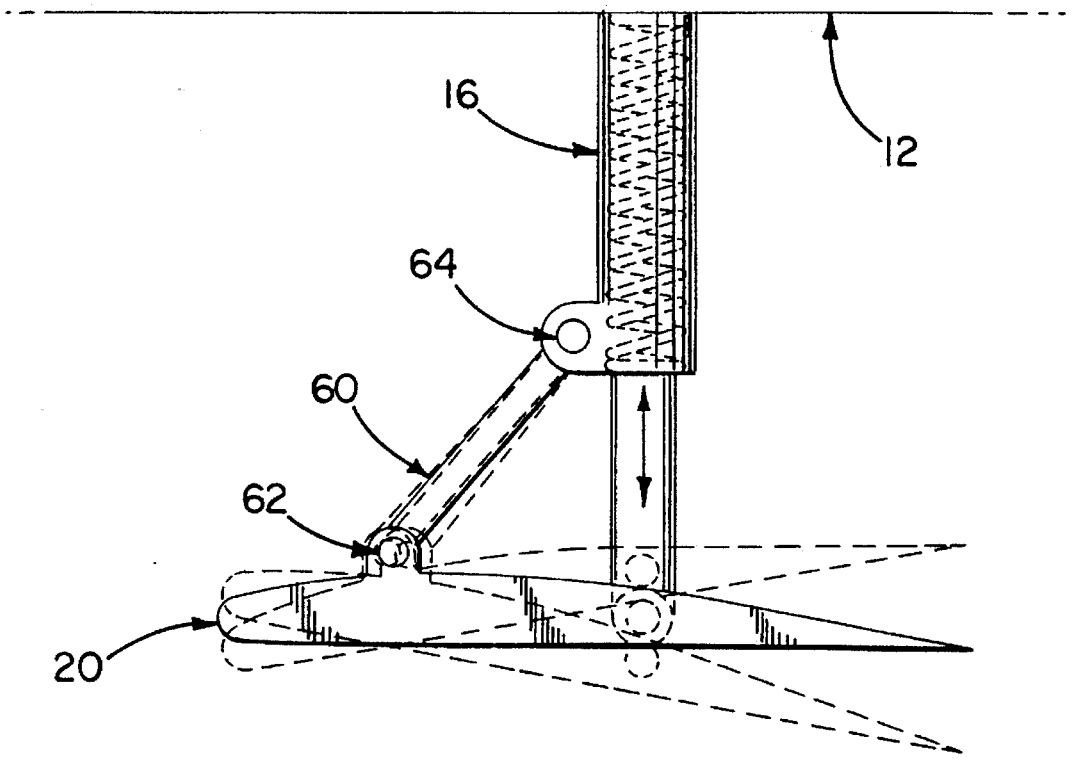
FIG. 11 is a side elevational view showing the way in which the angle of incidence at which foils, which are attached to support arms which extend vertically downward from the hull of the hydrofoil craft, encounter approaching water can be adjusted through the use of a shock strut.

Furthermore, where the attachment or connection 18 is rigid and each support arm 16 is not at least partially flexible, each support arm 16 can extend vertically downward from the hull 12 of the hydrofoil craft 10 and can be telescoping in nature, as is shown in FIGS. 6 and 11. These telescoping support arms 16 are cylinders which move up and down in response to the changes in local water velocity around the foils 20. The telescoping nature of these support arms 16 allows the foils 20 to move in concert with the local changes in water velocity while allowing the hull 12 of the hydrofoil craft 10 to track a path of approximately constant elevation above the water.

In contrast, where the attachment or connection 18 is pivotal, each support arm 16 is preferably rigid, although each support arm 16 can be at least partially flexible in the manner previously described. Furthermore, the pivotal attachment can be by any means known in the art.

Each support arm 16 is also attached to a foil 20. In embodiments where two support arms 16 are attached to the hull 12, it is preferable to have a main foil 20*a*, which provides most of the hull's support while foil-borne, attached to the support arm 16 located near the longitudinal center of gravity of the hull 12, while a smaller foil 20b is attached to the support arm 16 located under a forward or aft position of the hull 12.

As is illustrated in FIG. 3, foil 20 is located near the water's surface during the operation of the hydrofoil craft 10. The foil 20 creates the lift necessary to elevate the hull 12 of the boat above the water's surface. As is wellknown in the art, foils create the necessary lift through the angle of incidence at which the foils encounter the approaching water.

According to the present invention, the foils 20 can create the lift necessary to elevate the hull 12 of the hydrofoil craft 10 above the water's surface by having the angle of incidence at which the foils 20 encounter the approaching water adjusted in a number of ways including, but not limited to, employing a foil 30 with a hinged flap, or a tandem foil 40 or 50. FIG. 6 depicts a foil 30 with a hinged flap. The foil 30 has a main portion 32 of the foil 30 rigidly attached to the support arm 16. A rear flap 34 is pivotally attached to the main portion 32 of the foil 30 by any means known in the art, preferably a hinge, at a pivotal attachment or connection site 36.

When the foil 30 encounters an upgust or downgust of vertical water velocity, the rear flap 34 pivots and changes its orientation so that the effective angle of incidence at which the foil 30 encounters the approaching water is adjusted.

FIG. 7 depicts a tandem foil arrangement 40 which is stabilized by the forward foil 46. The tandem foil arrangement 40 has an aft foil 42 which is attached to a connecting structure 44 and a forward foil 46 which is also attached to the connecting structure 44. The tandem foil arrangement 40 is pivotally attached to the support arm 16 by any means known in the art, preferably by a pitch hinge, at a pivotal attachment or connection site 48. When the tandem foil arrangement 40 encounters a change in vertical water velocity, the angle at which the forward foil 46 attacks the approaching water is greater than the angle at which the aft foil 42 attacks the approaching water, the result of which being that the lift created by the forward foil 46 returns the tandem foil arrangement 40 to its original angle of incidence to the new relative water flow direction.

FIG. 8 depicts a tandem foil arrangement 50 which is stabilized by the aft foil 56. The tandem foil arrangement 50 has a forward foil 52 which is pivotally attached to the support arm 16 at an attachment or connection site 58 by any means known in the art, preferably a pitch hinge. The forward foil 52 is attached to a connecting structure 54 which, in turn, is attached to an aft foil 56. This aft foil 56 acts in the same way as the forward foil 46 of the tandem foil arrangement 40 acts; that is, when the tandem foil arrangement 50 encounters a change in vertical water velocity, the lift created by the aft foil 56 restores the tandem foil arrangement 50 to its original angle of incidence to the new relative water flow direction.

When the hull 12 has a very slender configuration, the foils 20 are preferably smaller than the foils typically found on conventional hydrofoil craft. These smaller foils can be used in combination with the slender hull because the slender hull can remain in nominal contact with the water up to a higher speed before "takeoff" than is possible with conventional hulls. This phenomenon increases the cruise efficiency of the hydrofoil craft because the foils can be smaller.

According to one aspect of the present invention, support arms 16 which extend angularly downward from the hull 12 into the water and which are not at least partially flexible are held in a downward, angular position by shock struts 22 which are connected to the support arms 16 by pivotal connection 26 and connected at or near the bottom of the hull 12 by pivotal attachment or connection 24 through any means known in the art, as is shown in FIG. 1. These shock struts 22 provide means which allow the support arms 16 and the foils 20 to move in concert with the changes in water velocity around the foils 20. Suitable shock struts 22 include, but are not limited to, mechanical compression springs, hydraulic cylinders, and pneumatic cylinders. Where cylinders are used as shock struts 22, accumulators are typically used in concert with the cylinders to reduce the spring rate or change its characteristics, as is well-known in the art.

As is depicted in FIG. 3, the shock struts 22 allow the support arms 16, and thus the foils 20, to move in concert with the changes in vertical water velocity (upgusts and downgusts) in waves located around the foils. If the water velocity around the foil 20 is locally going down (downgusts), the foil's lift is reduced and the shock struts 22 force the foil 20 to move in concert with the water and go down with it almost instantly to the lower position shown by dashed lines. On the other hand, where the water velocity is locally going up (upgust), the foil's lift is increased and the shock strut 22 allows the foil 20 to go up with it almost instantly to the upper position shown by dashed lines. Thus, the shock struts 22 allow the foils 20 to move almost instantaneously in response to these local upgusts and downgusts of water velocity. Because the support arms 16 are pivotably and not rigidly attached to the hull 12, this instantaneous foil movement does not affect the movement of the hull 12 of the boat, and the foils 20 move independently of the hull 12 of the boat. Accordingly, this support arm 16/shock strut 22/foil 20 construction allows the hull 12 of the boat to track a path of approximately constant elevation above the water's surface while the foils 20 move in concert with the local upgusts or downgusts of water velocity, thus affording the hull 12 of the boat a smooth ride in rough waters.

Figure 9:
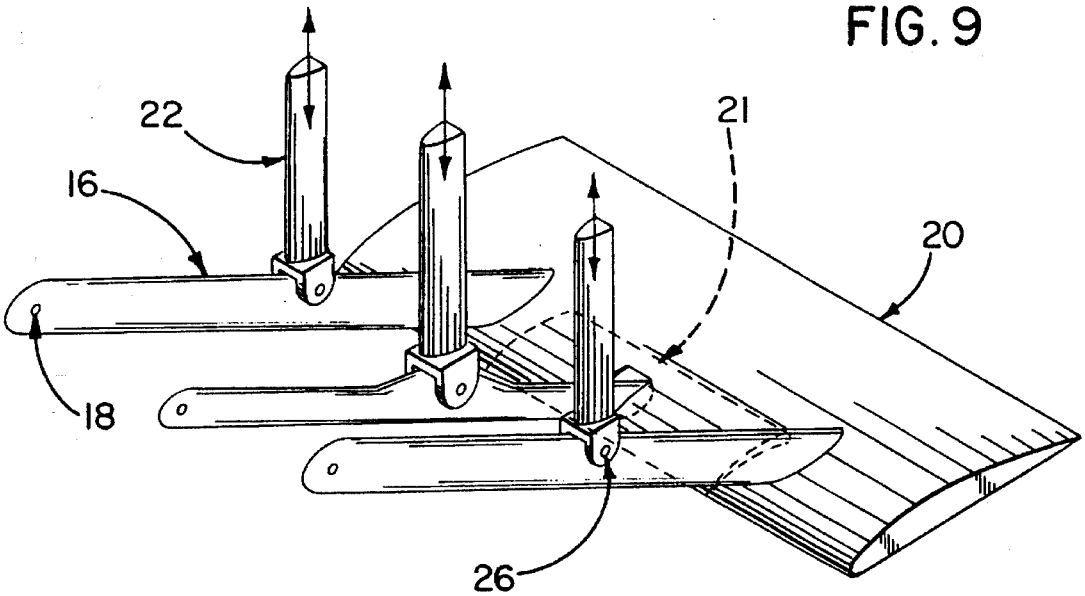
FIG. 9 is a perspective view showing both foils of a dual foil system, which can be used to reduce foil resistance at high speeds, both in a downward position.
Figure 10:
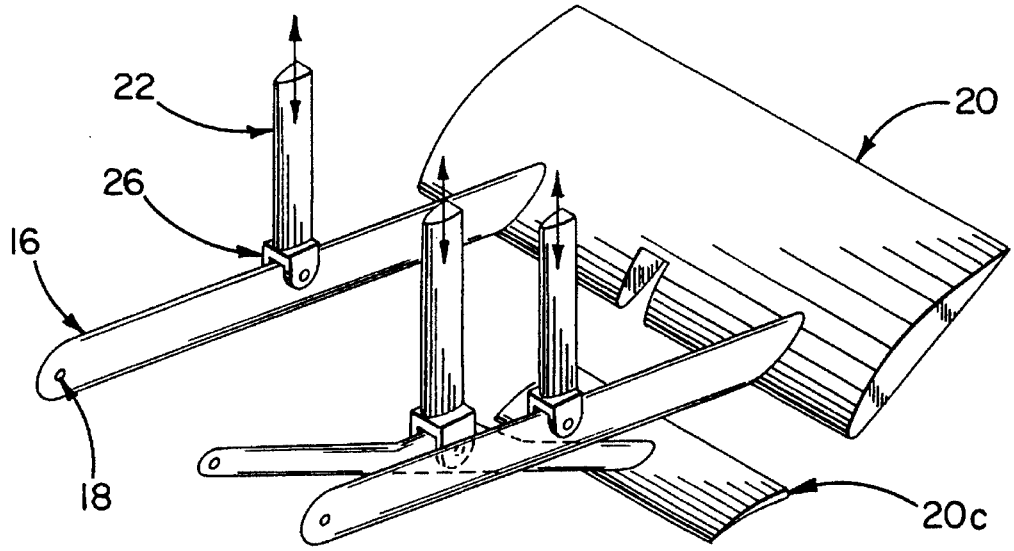
FIG. 10 is a perspective view depicting a dual foil system which can be used to reduce foil resistance in the water by lifting one of the foils out of the water.

Furthermore, the support arm 16/shock strut 22/foil 20 system permits another way in which the size of the main foil 20*a* may be reduced at high speeds, thus reducing the resistance of the hydrofoil craft 10 at high speeds. As is shown in FIG. 9, two "main foils" can be down in the water at low speeds: one large foil 20 for low speed operation and a small foil 20(*c*) for high speed operation. At low speeds these foils can be nested together or they can be in tandem. On reaching a high enough speed for the small foil 20(*c*) to be able to support the weight of the craft 10 by itself, the large foil 20 is lifted out of the water so that it rests against or close to the bottom of the hull 12 by retracting the shock struts 22 which were previously holding it down, as is shown in FIG. 10. Preferably, the large foil 20 is hinged near its leading edge with respect to its support arm[s] so that the foil 20 points into the relative water flow when retracted. All of the weight of the hull 12 is then carried by the shock strut 22 which holds down the support arm 16 which is attached to the smaller foil 20(*c*).

In addition to greatly reducing the resistance of the craft 10 at high speeds, this method permits different types of foil to be employed at low and high speeds. The low speed foil would typically have a sectional shape similar to that of an aeroplane wing, with a rounded leading edge, known as a "subcavitating foil" which can efficiently develop high lift coefficients. The small foil 20(*c*) for high speeds, on the other hand, would typically be of the "supercavitating" type, designed to operate with an air-filled cavity above its upper surface.

The support arm 16 which is attached to the large foil 20 preferably has conventional streamline sections, e.g., the support arm 16 possesses leading and trailing edges which are more narrow relative to the center of the support arm 16, so that atmospheric air cannot find its way down the support arm 16 to vent the upper surface of the foil 20 and thus reduce its lift. The support arm 16 which is attached to the small foil 20(*c*), on the other hand, preferably has blunt trailing edges to provide an easy path down the support arm 16 for atmospheric air to ventilate the upper surface of the small foil 20(*c*).

According to the present invention, the angle of incidence at which the foils 20 contact the approaching water is adjusted automatically so as to minimize a reduction in lift when the foils 20 encounter a downgust or minimize an increase in lift when the foils 20 encounter an upgust. This automatic adjustment can be accomplished by any means known in the art or previously discussed herein.

Preferably, the angle of incidence at which the approaching water contacts the foil 20 is adjusted by the same means which adjusts the movement of the foil 20. Namely, the angle of incidence is adjusted by the support arm 16/shock strut 22/foil 20 system. This simultaneous adjustment of both the angle of incidence at which the foil 20 attacks the approaching water and the position of the foil 20 in the water by moving the support arms 17 in concert with the changes in vertical water velocity in waves located around the foil 20 is effected by the foil 20 being rigidly connected to the support arms 16. Thus, when the hydrofoil craft 10 encounters a downgust, the foil 20 goes down with the water and, because the foil is rigidly connected to the support arms, the angle of incidence at which the foil 20 contacts the water is necessarily adjusted so as to minimize a reduction in lift. Conversely, when the hydrofoil craft 10 encounters an upgust, the foil 20 goes up with the water and the angle of incidence at which the foil 20 contacts the approaching water is automatically adjusted so as to minimize an increase in lift. This system allows not only the foil's location in the water but also the angle of incidence at which the foil contacts approaching water to be adjusted instantaneously, thus affording the hull 12 of the boat a smooth ride in rough water. Accordingly, in preferred embodiments no foil-mounted control mechanisms are necessary.

According to one aspect of the present invention, the foil 20 in the support arm 16/shock strut 22/foil 20 system can be a foil 30 with a hinged flap. Preferably, the hinge line is close to the leading edge of the foil 30. Using a foil 30 with a hinged flap in this position results in the hinged flap "feathering" into the relative water flow when it encounters a downgust of vertical water velocity and being held against a stop when it encounters an upgust of vertical water velocity, thus minimizing the resistance of the foil 20 when it is in a retracted position.

According to another aspect of the present invention, support arms 16 which extend angularly downward from the hull 12 into the water and which are at least partially flexible are held in a downward, angular position by an attachment or connection 18 which is rigid. The flexible nature of the support arms 16 allows the support arms 16 to bend in response to the changes in water velocity around the foils 20 almost instantaneously and thus to move in concert with the local upgusts or downgusts of water velocity. Because the flexible support arms bend in response to the changes in vertical water velocity around the foils 20, the instantaneous movement does not affect the movement of the hull of the boat, thus affording the hull 12 of the craft a smooth ride. Moreover, the same mechanism which adjusts the location of the foil 20 in the water preferably adjusts the angle of incidence at which the foil 20 attacks the approaching water. As is previously described, the angle of incidence at which the foils 20 contact the approaching water is preferably adjusted by rigidly attaching the foils 20 to the flexible support arms so that the angle of incidence at which the foils 20 contact the approaching water is adjusted by the same means which adjusts the movement of the foils 20, although any means of adjusting the angle of incidence which has been previously discussed or which is well-known in the art can be used.

According to yet another aspect of the present invention, telescoping support arms 16 which are not at least partially flexible and which extend vertically downward from the plane of the bottom of the hull 12 into the water can be used. The telescoping nature of these support arms 16 allows the foils 20 to move in concert with the changes in vertical water velocity around the foils, as is depicted in FIG. 11, and thus affords the hull 12 of the craft 10 a smooth ride. Again, it is preferred that the same mechanism which adjusts the position of the foil 20 in the water also adjusts the angle of incidence at which the foil 20 attacks the approaching water. Although any means of adjusting the angle of incidence which has been previously discussed or which is well-known in the art can be used, preferably, the angle of incidence at which the foils 20 contact the approaching water is adjusted by pivotally attaching a hinged link 60 to the foil 20 and the support arm 16 at pivotal attachment or connection sites 62 and 64, respectively. When the foil 20 encounters a change in vertical water velocity, the foil 20 moves in concert with the water due to the telescoping nature of the support arm 16 and the angle of incidence at which the foil 20 encounters approaching water is automatically adjusted due to the hinged link 60 changing the position of the foil 20 upon movement of the support arm 16, as is shown in FIG. 11.

Another advantage which the hydrofoil craft 10 of the present invention possesses is that the hydrofoil craft 10 can use supercavitating foils because it has the ability to move its foils 20 up and down in concert with the changes in vertical water or air velocity located around the foils 20. A supercavitating foil is a foil which at high speeds does not have any water flow contacting the upper surface of the foil, thus creating a cavity above the foil. At high speeds in calm water, this cavity contains only water vapor at very low pressure. If a supercavitating foil is at a low enough angle of incidence for efficient (low drag) operation, the vapor-filled cavity is unstable and the forces on the foil very randomly and violently. If such a foil gets too close to the surface of the water, the low pressure of the vapor cavity can suck in atmospheric air causing the foil's lift to fall to about one-third of its supercavitating value. See, Conolly, Alan, "Prospects For Very High Speed Hydrofoils," *Marine Technology*, Volume 12, No. 4, pp. 367–377 (1975). It is believed that because of this sudden decrease in lift when a supercavitating foil gets too close to the water's surface, such supercavitating foils are not in practical use today. However, such supercavitating foils can be employed on the hydrofoil craft 10 of the present invention because the rapid changes in lift caused by the instability of the cavity merely causes the support arms 16 attached to the craft 10 to move up and down appropriately so as to reduce or to increase the angle of incidence of the foils 20 so as to maintain lift, thus assuring the hull 12 of the craft 10 a smooth ride.

Furthermore, where the support arms 16 extend angularly downward from the hull 12 of the craft 10 into the water, the resistance of such supercavitating foils, for a given lift, is minimized by the fact that atmospheric air is continuously available to the cavity above the foil due to the angle at which the support arms 16 are inclined. Having the support arms 16 inclined at an angle to the vertical, as is depicted in FIG. 3, results in a significant decrease in the amount of drag and, therefore, resistance which is due to the dynamic pressure of the water contacting the support arms 16. For example, when the support arms are disposed at an angle of 60° with respect to the vertical (a typical value), cos 30°=0.5 and, therefore, the ratio $$\frac{\text{inclined support arm drag}}{\text{vertical support arm drag}}$$

(which is approximately equal to $\cos^2$ of the angle with respect to the vertical) is approximately 0.25. Thus, the pressure drag which results from the water contacting a support arm 16 which extends angularly downward is only 0.25 or 25% of the pressure drag which results from a vertical support arm contacting water. Accordingly, a support arm 16 which extends angularly downward from the hull 12 can be four times as wide as a vertical support arm while being subject to an equivalent amount of drag, and the cross-sectional area of the cavity behind the support arm 16 which extends angularly downward can be sixteen times as great as the cavity behind a vertical support arm, thus permitting sixteen times as much air to flow down behind the inclined support arm.

Furthermore, in the present invention, the foil 20 can be attached to the inclined support arm 16 by or near to its leading edge. Therefore, the atmospheric air traveling down the back of the inclined support arm 16 does not need to force its way against the water flow because it is already upstream of the cavity which it must feed. Furthermore, if no cavity already exists above the foil, this atmospheric air traveling down the back of the support arm will allow one to form as soon as it reaches the leading edge of the foil.

In preferred embodiments, the resiliency and damping characteristics of the shock strut 22/support arm 16/foil 20 system can be instantly changed, at the flip of a switch, from the wheelhouse of the hydrofoil craft 10. Changing these characteristics allows the hull 12 of the boat to obtain the optimum ride comfort in varying sea conditions. The manner in which the characteristics of the shock strut 22/support arm 16/foil 20 system can be changed depends upon the particular embodiment of this system.

For example, where the shock strut 22 is a hydraulic cylinder, the pressure of the gas in the accumulator which is connected to the hydraulic cylinder can be decreased to soften the ride or increased to stiffen the ride, depending on the condition of the sea. This adjustment can easily be controlled from the wheelhouse of the hydrofoil craft 10.

Also in preferred embodiments, the shock strut 22/support arm 16/foil 20 system can be controlled from the wheelhouse such that this system, at the flip of a switch, can be stored close to the hull 12 of the craft so that the foils 20 fit snugly against the bottom of the hull 12. When the foils 20 are stored snugly against the hull 12, the hydrofoil craft 10 can operate with reduced draft at low speeds.

According to the present invention, propeller assemblies 28 can be mounted anywhere on the hydrofoil craft 10. Preferably, the propeller assembly 28 is mounted on or behind at least one foil 20 and, more preferably, the propeller assembly 28 is mounted on the main foil 20*a* because it is the only part of the hydrofoil craft 10 which is in unequivocal water contact nearly all of the time. However, this is more costly than a conventional propeller installation and, therefore, may not always be economically desirable.

The propeller assembly 28 can include at least one propeller attached to the output member of a hydraulic motor which is mounted in a pod located on or behind the foil 20. The hydraulic motor and thus the propeller are driven by pressurized fluid from a hydraulic pump mounted on the engine of the hydrofoil craft 10. Two hydraulic lines which are attached at one end to the hydraulic motor and at the other end to the hydraulic pump carry the pressurized fluid back and forth between the hydraulic motor and the hydraulic pump. The hydraulic lines either must be flexible or incorporate a mechanical hinged joint so as to allow the foil to which the pod and hydraulic motor are attached to move in concert with the changes in water velocity around the foils.

Preferably, the hydraulic pump which is mounted on the engine of the hydrofoil craft 10 is a variable displacement pump. The variable displacement pump pressurizes the hydraulic fluid at a constant power level, so that if the flow is reduced because the motor is slowed by a greater torque load on the propeller, the fluid pressure increases. Ideally, halving the flow rate doubles the pressure. Thus, at low boat speeds, where the propeller torque is high and the motor is turning slowly, the fluid pressure is also high, maximizing the torque available in the motor. The overall effect is that of a variable gear ratio between the engine and the propeller.

In other embodiments, the propeller assembly 28 can include at least one propeller attached to the output member of an electric motor which is mounted in a pod located on the foil 20. Any device known in the art for transporting electric current through a rotating joint may be used to transport electric current produced by generators mounted on the engines of the hydrofoil craft 10 to the electric motor so as to drive the electric motor and thus the propeller. Preferably, either flexible wires or hinged commutators transport the electric current so as to allow the foil, which can be attached to the pod, to move in concert with the changes in water velocity around the foils 20.

Finally, the propeller assembly 28 can include at least one propeller attached to a mechanical transmission means. Where the propeller is mounted on a foil 20, the mechanical torque needed to drive the propeller is transmitted from the engine to the propeller through input (from the engine) and output (to the foil) shafts which are connected by a joint or linkage which can accommodate the up and down movement of the foil 20 so that the foil 20 can move in concert with the changes in vertical water velocity located around the foil 20. For example, a Hooke's joint, constant velocity joint, or a flexible rubber coupling which is coincident with the hinge axis center line of the foil 20/support arm 16 hinges can be used to connect the input and output shafts. Preferably, a gear box which allows the output shaft to swivel about a horizontal axis which is coincident with the foil 20/support arm 16 hinge center line is used. An example is a gear box which has two beveled gears facing each other and which is orthoganol to the water's surface. Driving pinions interact with and engage the beveled gears. One driving pinion is attached to a shaft which, in turn, is attached to the engine of the hydrofoil craft. This driving pinion allows the mechanical transmission of energy from the engine of the hydrofoil craft to the gear box. The other driving pinion is attached to a shaft which extends from the beveled gear box to a lower gear box located near the propeller. This shaft allows the mechanical transmission of energy from the beveled gear box to the lower gear box. Where the shaft from the upper gear box is at an angle of 30° to the water's surface so that it enters the lower gear box at this angle, the lower gear box has an output shaft which is roughly longitudinal, or parallel to the water's surface. Thus, in this example, the angle between the input and output shafts of the lower gear box is also 30°. The output shaft from the lower gear box, in turn, is attached to at least one propeller located on the foil 20.

FIGS. 12–17 illustrate another embodiment of a hydrofoil craft according to the present invention. In this embodiment, a hull 110 is supported above the water by a main foil 120 and by smaller auxiliary foils 130 located at the stern of the hull 110. At operating speed, the hull 110 is primarily supported by the lift generated by the main foil 120 and is stabilized in pitch by the auxiliary foils 130. The main foil 120 is rigidly connected to a pair of rigid support arms 121 which are pivotably connected to the hull 110 near their upper ends for pivoting about a transverse axis 122 extending substantially perpendicular to the centerline plane of the hull 110. The main foil 120 is shown extending substantially perpendicular to the centerline plane of the hull 110, although it can be at a different angle, such as sloping upwards. Furthermore, it can be connected to the hull 110 by a different number of support arms 121. The upper end of at least one of the support arms 121 extends into the hull 110 and is connected to a shock strut 123 or similar member which exerts a downwards biasing force on the support arms 121 to prevent their collapsing against the hull 110 under the weight of the hull 110 while enabling the support arms 121 to pivot about the transverse axis 122 so that the main foil 120 can move up and down in concert with upgusts and downgusts of water surrounding the main foil 120. The shock strut 123 can be, for example, a mechanical, pneumatic, or hydraulic shock strut like those used in the previous embodiments. If the shock strut 123 is hydraulic, it can be used not only to permit pivoting motion of the support arms 121 about the transverse axis 122 in response to upgusts and downgusts, but it can also be used to move the support arms 121 between a retracted position and a lowered position. The shock strut 123 is preferably capable of permitting vertical movement of the foil 120 in response to upgusts and downgusts by approximately the height of the largest waves (measured from trough to crest) in which the boat is intended to operate. For example, if the boat is intended to operate in three-foot waves, the shock strut 123 preferably permits the foil 120 to move upwards and downwards by approximately three feet (approximately 1.5 feet upwards and 1.5 feet downwards from its mean position in calm water). Although it is not necessary for the shock strut 123 to be disposed inside the hull 110, this arrangement has the advantage that it produces less drag than when the shock strut 123 extends into the water. In the present embodiment, the force exerted by the shock strut 123 on the support arms 121 can be adjusted by a control unit 125 (shown in FIG. 13) mounted in the hull 110 and connected to the shock strut 123.

Ideally, the biasing force exerted by the shock strut 123 on the support arms 121 is substantially constant over the range of pivoting movement of the support arms 121 as the main foil 120 moves in concert with upgusts and downgusts, since this will minimize the accelerations applied to the hull 110. With actual shock struts 123, however, the restraining force will vary as the support arms 121 pivot from their mean position in calm water, increasing as the support arms 121 pivot upwards and decreasing as they pivot downwards.

There are no strict limits on the range of variation of the biasing force exerted by the shock strut 123 as the support arms 121 are displaced from their mean calm water position. If the biasing force is given an arbitrary value of 1.0 when the main foil 120 is at its mean distance from the hull 110 in calm water, then an example of a suitable range of variation of the biasing force is a value of at least approximately 0.5 when the foil 120 is reaches the bottom of its downward movement in response to a downgust and a value of at most approximately 2.0 when the foil 120 is reaches the top of its upward movement in response to an upgust. An example of a more preferred range is a value of at least approximately 0.8 when the foil 120 reaches the bottom of downward movement and a value of at most approximately 1.4 when the foil 120 reaches the top of upward movement. Thus, in the more preferred range, if the biasing force is just sufficient to enable the support arms 121 to support the weight of the hull when the main foil 120 is at its mean depth in calm water, then the biasing force becomes sufficient to enable the support arms 121 to support at least 0.8 times the weight of the hull when the foil 120 reaches the bottom of downward movement and sufficient to enable the support arms 121 to support at most 1.4 times the weight of the hull when the foil 120 reaches the top of its upward movement.

The above-described preferred and more preferred ranges on the biasing force exerted by the shock strut are also applicable to the shock struts used in the previous embodiments. Furthermore, in the case where the support arms are flexibile members and resist upward forces acting on the foil by their resilience, the downward biasing force exerted by the flexible support arms preferably is from at least approximately 0.5 to at most approximately 2 times the weight of the hull and more preferably from at least approximately 0.8 to at most approximately 1.4 times the weight of the hull as the foil moves between its lowest and highest positions with respect to the hull in response to downgusts and upgusts.

The hydrofoil craft is steered by means of a pair of rudders 131 mounted on the stern of the hull 110 for pivoting about substantially vertical axes. The auxiliary foils 130 are secured to the lower ends of the rudder 131. The angle of each rudder 131 with respect to the centerline of the hull 110 can be adjusted by means of suitable actuators 132, such as hydraulic pistons or electric motors connected to the rudders 131 and controlled by the control unit 125. In the present embodiment, each of the rudders 131 is pivotably mounted on a support plate 133 which is connected at its upper end to the stern of the hull 110 by hinges 134 which so that the support plate can pivot about a horizontal axis extending substantially perpendicular to the centerline of the hull 110. Each support plate 133 can be pivoted about its hinges 134 by an actuator 135 supported by the hull 110 and controlled by the control unit 125. Operation of the actuators 135 adjusts the angle of the longitudinal axes of the rudders 131 with respect to the vertical and accordingly adjusts the angle of incidence of the auxiliary foils 130. For example, if the rudders 131 are inclined backwards by five degrees by operation of actuators 135, the angle of incidence of the auxiliary foils 130 is reduced by five degrees, resulting in a larger downward-acting force being developed upon them, which raises the bow of the boat. Conversely, retracting the cylinders 135 will incline the rudders 131 forward, increasing the angle of incidence of the auxiliary foils 130 and raising the stern of the boat.

Preferably, each of the actuators 132 and 135 can be independently controlled. If the rudders 131 are differentially inclined, one forward and the other backwards, the lift on the former will be increased and the lift on the latter will be reduced, thus applying a rolling moment to roll the boat toward the side on which the auxiliary foil lift was reduced. When this is done at the same time as actuators 132 are used to steer the rudders 131, the boat will both turn and bank in the direction of the turn.

Figure 15:
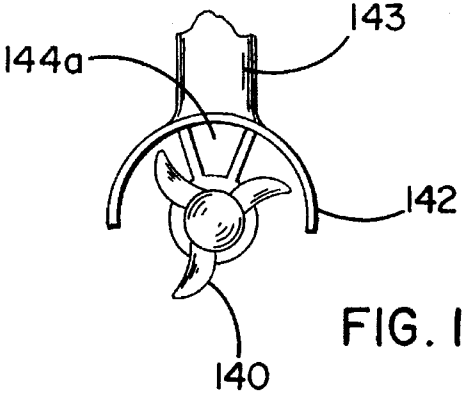
FIG. 15 is a rear elevation of the propeller of the embodiment of FIG. 12.
Figure 14:
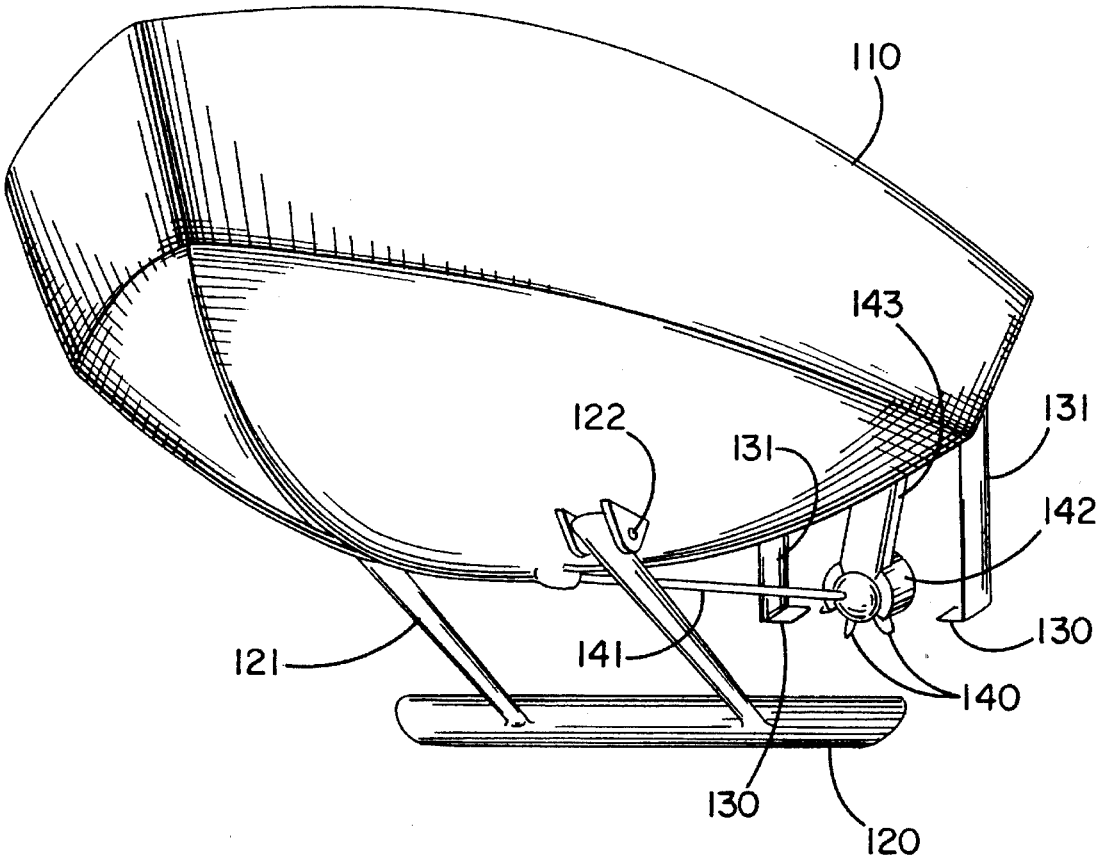
FIG. 14 is a perspective view of the embodiment of FIG. 12 as view from the bow.

The hydrofoil craft can be propelled by any suitable propulsion device, such as a propeller 140 driven by an unillustrated engine mounted inside the hull 110 through a propeller shaft 141 extending diagonally downwards from the hull 110. The propeller thrust can be reacted by a thrust bearing inside a bearing housing and transmitted to the hull 110 via a propeller support strut. In this embodiment, the propeller 140 is at least partially surrounded by a streamlined cowling 142 which communicates with the atmosphere through a hollow ventilating tube 143 having a bore 144 with an upper end disposed above the surface of the water. The lower end 144*a* of the bore 144 opens onto the inside of the cowling 142 on the suction side of the propeller 140. The portion of the ventilating tube 143 which is submerged during operation of the hydrofoil craft preferably has a streamlined cross-section so as to reduce drag. As shown in Figure 15, in the present embodiment, the cowling 142 extends around the upper portion of the propeller 140 for somewhat over 180 degrees, but the exact dimensions of the cowling 142 are not critical.

The cowling 142 and the ventilating tube 143 help to stabilize the thrust of the propeller 140 during operation in waves. The depth of the propeller 140 beneath the water surface will fluctuate with the rise and fall of waves, and at times, portions of the propeller 140 may be above the water surface. Without the cowling 142 and the ventilating tube 143, the periodic rise of the propeller 140 above the water surface would result in large fluctuations of the torque and rotational speed of the propeller 140, since at times, the entire propeller 140 would be submerged, and at other times, only a portion of the propeller 140 would be below the water surface.

Figure 12:
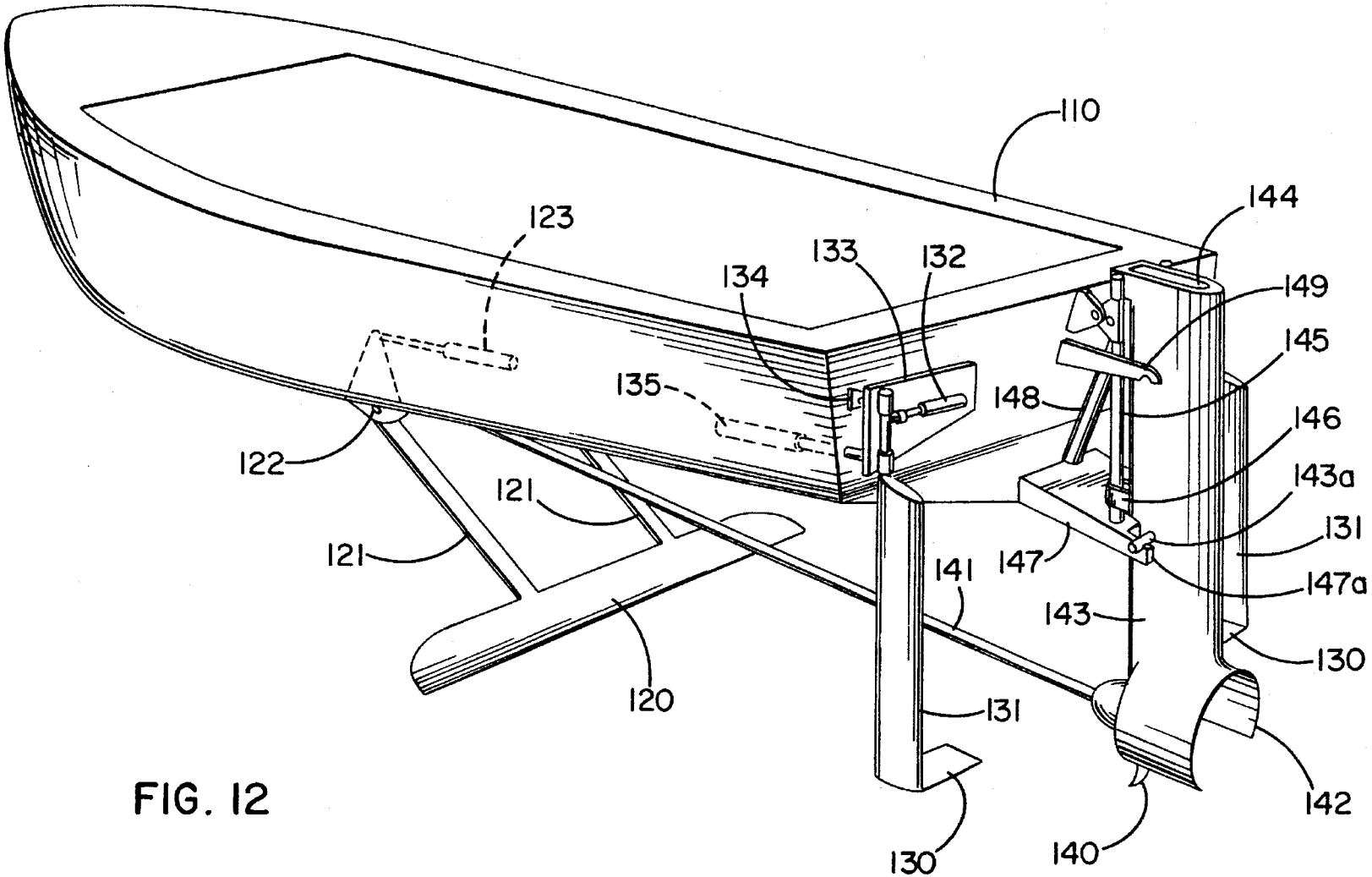
FIG. 12 is a perspective view of another embodiment of a hydrofoil craft according to the present invention as viewed from the stern.

However, in the embodiment of FIG. 12, atmospheric air at the upper end of the ventilating tube 143 is drawn through the ventilating tube 143 and into the cowling 142 by the suction generated by the rotation of the propeller 140, and this causes the local water surface within the cowling 142 to be depressed and expose the upper portion of the propeller 140 to air, whereby less than the entire propeller 140 is immersed. For example, the water level within the cowling 142 can be lowered to approximately the level of the propeller shaft 141 so that only the lower half of the propeller 140 develops thrust. Therefore, the level of the water surface within the cowling 142 with respect to the propeller 140 can be maintained approximately constant regardless in fluctuations in the water surface outside the cowling 142. The net effect is that the power required to drive the propeller 140 is about the same whether the propeller 140 is closed to the water surface or deeply submerged. The cowling 142 accentuates the suction generated by the propeller 140 and also ensures that the air sucked down the ventilating tube 143 flows through the propeller disc.

Another advantage of the cowling 142 and the ventilating tube 143 is that cavitation can never occur on the propeller blades because their suction face is ventilated at atmospheric pressure. This increases the lifespan of the propeller 140 by preventing damage due to cavitation.

Figure 13:
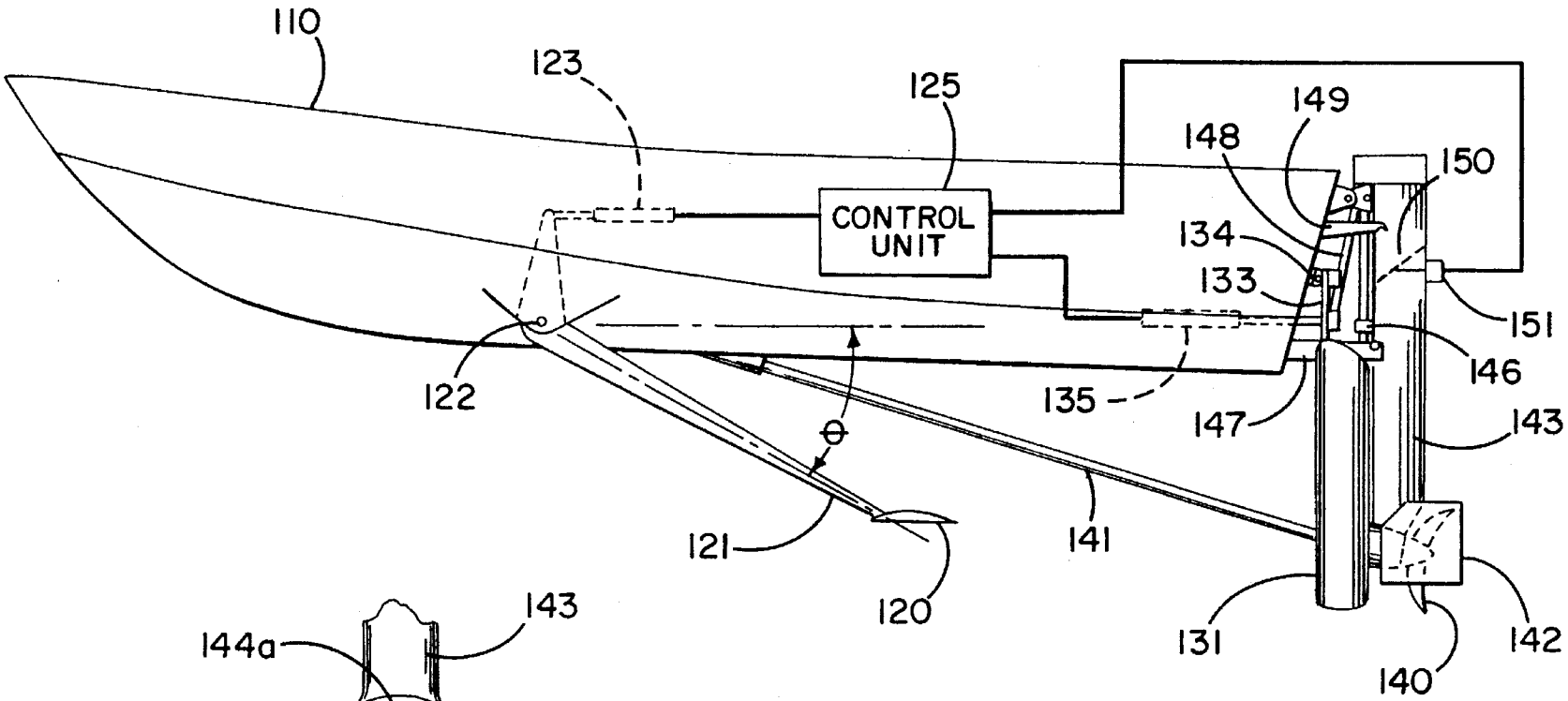
FIG. 13 is a schematic side elevation of the embodiment of FIG. 12.

Preferably, the ventilating tube 143 is equipped with means for varying the air flow rate through the ventilating tube 143. For example, as shown in FIG. 13, a remotely controllable flow valve such as a butterfly valve 150 can be installed in the bore 144 at any convenient location. The butterfly valve 150 is opened and closed by a suitable actuator 151, which can be controlled by the control unit 125. As the butterfly valve 150 is moved towards a closed position, the supply of air to the propeller 140 is reduced, and the propeller 140 is more heavily loaded.

The bore 144 of the ventilating tube 143 is preferably sized so that when the butterfly valve 150 is fully open and the craft is running at its design speed, the water level within the cowling 142 will be lowered to a desired level. The dimensions of the bore 144 of the ventilating tube 143 can be calculated roughly as follows. If V is the boat's design speed and $A_p$ is the swept area of the propeller disc, the required air flow rate through the bore 144 so that the upper half of the propeller 140 will be ventilated is $$0.5\ VA_p\ (\text{ft}^3/\text{second}).$$

It is desirable to keep the air velocity in the bore 144 below one-quarter the speed of sound in air (about 280 feet per second), so the minimum desirable area of the bore 144 in order to ventilate the upper half of the propeller 140 is $$VA_p/560\ (\text{square feet}).$$

The propeller 140 may be supported at a fixed location with respect to the hull 110. However, during operation of the hydrofoil craft, the optimal operating depth of the propeller 140 below the surface of the water will vary in accordance with the speed of the hydrofoil craft. Therefore, in the present embodiment, the propeller 140 is supported such that it can be raised and lowered at will, while the hydrofoil craft is moving. The ventilating tube 143 is slidably connected by one or more connectors 146 to a guide rod 145 extending upwards from a support base 147 connected to the stern of the hull 110. The ventilating tube 143 can be raised and lowered by any suitable actuator, such as a hydraulic actuator 148 connected between the ventilating tube 143 and the support base 147 and controlled by the control unit 125. The range of vertical movement of the ventilating tube 143 is limited by engagement between a pin 143*a* secured to the exterior of the ventilating tube 143 and a lower stopper arm 147*a* attached to the support base 147 or an upper stopper arm 149 secured to the transom. In the figures, the ventilating tube 143 is shown in a lowered position in which the pin 143 contacts the lower stopper arm 147*a*. The propeller shaft 141 is pivotable with respect to the hull 110, and the cowling 142 is connected to the propeller 140 such that operation of the actuator 148 causes the propeller 140, the propeller shaft 141, the cowling 142, and the venting tube 143 to move up and down as a single unit. The propeller shaft 141 can be connected to the hull 110 by a cardon joint (or "Hook's joint"), for example, to enable it to pivot with respect to the hull 140.

Structuring the ventilating tube 143 so that it can be raised and lowered also provides the advantage that the draft of the boat can be reduced when it is moving slowly or stationary. The rudders 131 can also be raised to a retracted position by extending the actuators 135 to rotate the support plates 133 about the hinges 134.

In FIG. 12, the main foil 120 is shown rigidly connected to the support arms 121. However, as shown in FIGS. 16*a*–16*c*, the main foil 120 can be pivotably connected to the support arms 121. In these figures, which are respectively a bottom plan view, a partially cross-sectional side view, and a top plan view, the main foil 120 is connected to the support arms 121 for pivoting about a pivot point 120*a*. The main foil 120 can freely pivot downwards about the pivot point 120*a* to at least an angle in which it is "feathered" i e approximately aligned with the axis of the support arms 121. However, its pivoting motion in the upwards direction is limited by a stopper member secured to each support arm 121. In this embodiment, the stopper member is a stopper arm 121*a* extending from the rear and of each support arm 121 over the leading edge of the main foil 120. When the hydrofoil craft is operating in calm water without upgusts or downgusts, lift forces on the main foil 120 urge it to the position shown by solid lines in FIG. 16*b* in which the upper surface of the main foil 120 is pressed against the stopper arms 121*a*. Similarly, when the main foil 120 is subject to an upgust, it will be pressed against the stopper arm 121*a*. When the main foil 120 is subjected to a downgust of sufficient magnitude, it will pivot downwards about the pivot point 120*a* in the clockwise direction in FIG. 16*c* to the position shown by dashed lines. Pivotably connecting the main foil 120 to the support arms 121 in this manner decreases the fluid resistance of the main foil 120 when it is in a retracted position, because the main foil 120 can pivot to the angle of least resistance.

When the main foil 120 is subjected to an upgust, the direction of the hydrodynamic force vector acting on the main foil 120 shifts relative to its direction when the main foil 120 is stationary. In order for the main foil 120 to be stable in an upgust, the hydrodynamic force vector should lie along a line which interests the hull at a point to the rear of the transverse axis 122 about which the support arms 121 pivot. This line usually intersects the main foil 120 at approximately its quarter chord. If this line passes to the rear of the transverse axis 122, an upgust will cause the support arms 121 to pivot backwards about the transverse axis 122, as desired. However, if the hydrodynamic force vector lies along a line passing forward of the transverse axis 122, an upgust will cause the support arms 121 to pivot forward instead of backwards. As the support arms 121 pivot forwards, the angle of incidence of the main foil 120 will increase, further increasing the lift acting on the main foil 120 and creating an unstable situation in which the support arms 121 continue to pivot forwards until they violently encounter some mechanical stop. As a result, a large and undesirable upward acceleration will be imparted to the hull 110.

The direction of the force vector will depend on the velocity of the upgusts acting on the main foil 120, which is probabilistic in nature. The closer the support arms 121 are to the vertical, the higher is the probability that an upgust will occur that will cause the support arms 121 to pivot forwards instead of backwards. In order to reduce the probability of the support arms 121 pivoting forward to a low level and guarantee safe operation, the angle Θ with respect to the horizontal of a line between the transverse axis 122 and the quarter-chord of the main foil 120 when the hull 110 is foil-borne and the main foil 120 is substantially stationary with respect to the hull 110 is preferably less than approximately 60 degrees and more preferably less than approximately 40 degrees. Exemplary values within these preferred ranges include all integer and fractional values from 0 to 60 degrees, and examples of suitable ranges within these preferred ranges include from 10 degrees to 40 degrees, from 0 degrees to less than 30 degrees, and from greater than 30 degrees to 60 degrees. These preferred ranges of angles also apply to the embodiments shown in FIGS. 1–11 in which the support arms are at an angle with respect to the vertical. In the example shown in FIG. 12, with the hull 110 foil-borne in calm water, the angle e is approximately 30 degrees.

Figure 17:
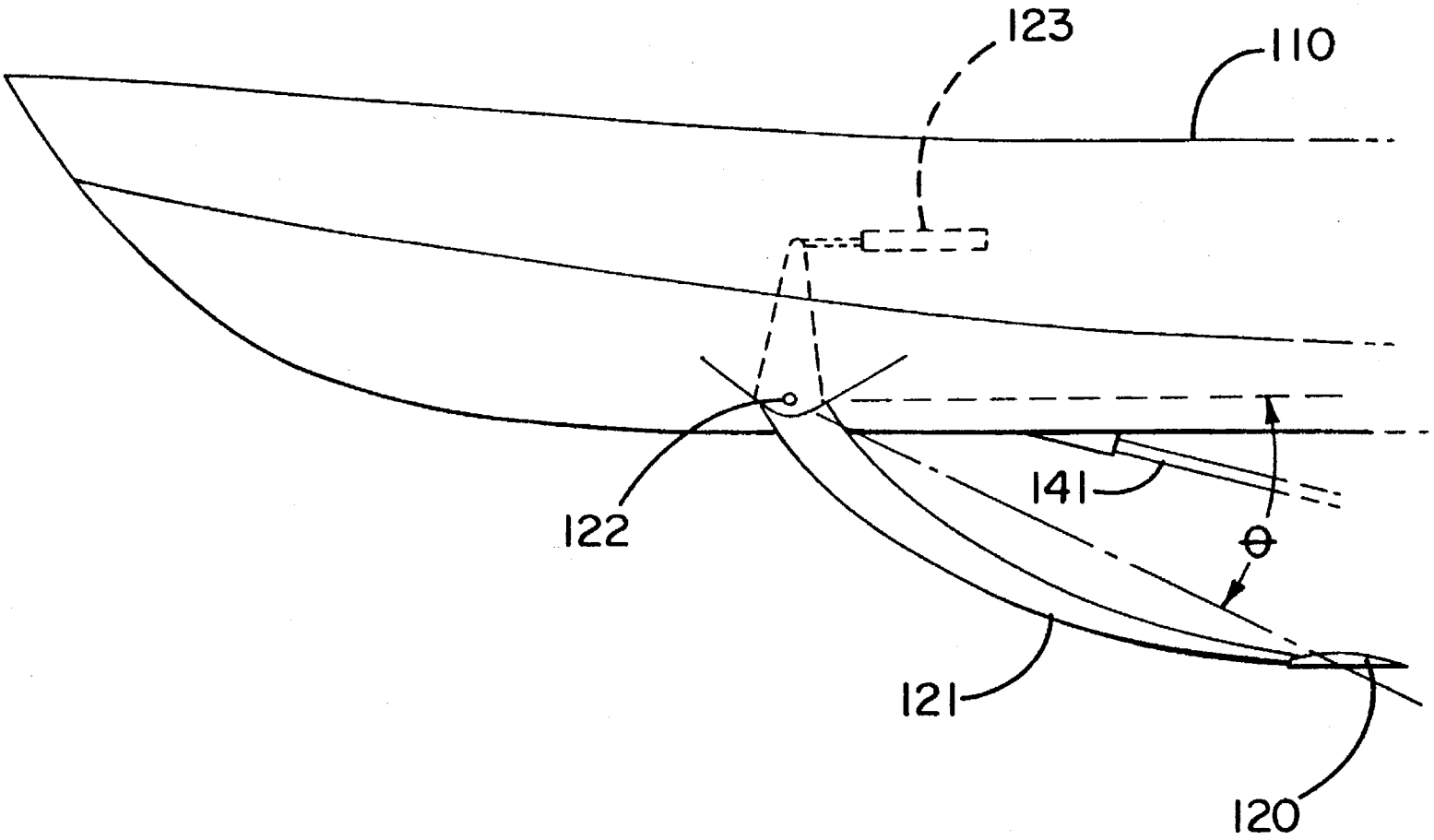
FIG. 17 is a schematic side view showing a variation of the embodiment of FIG. 12 having curved support arms.

In FIG. 12, the support arms 121 are substantially straight members, but as shown in FIG. 17, it is also possible for the support arms 121 to be curved between the transverse axis 122 and the main foil 120. In this case as well, to give adequate foil stability, the angle Θ is preferably in the same range as when the support arms 121 are straight.

Figure 18:
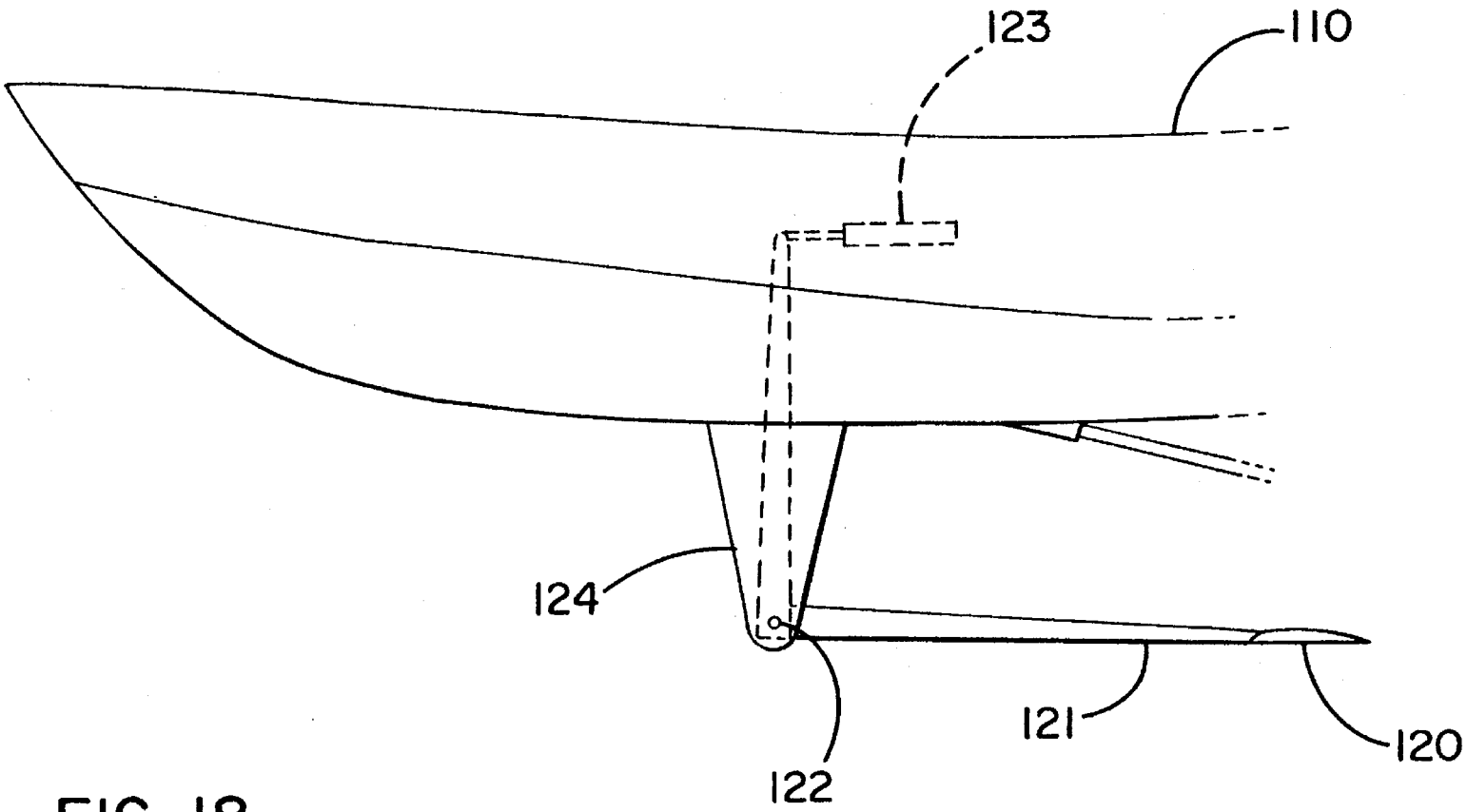
FIG. 18 is a schematic side view of an embodiment having substantially horizontally extending support arms.

The smaller the mean angle of the support arms with respect to the horizontal, the smaller are the vertical force fluctuations transmitted to the hull, and therefore the smoother the ride. Thus, the ride is smoothest when the angle of the support arms to the horizontal is zero. FIG. 18 illustrates a variation of the embodiment of FIG. 12 in which the support arms 121 are supported such that their mean angle with respect to the horizontal in calm water is approximately zero. Instead of support arms 121 being pivotably supported by the hull 110 itself, they are supported for pivoting about a transverse axis 122 by a rigid strut 124 extending downward from the bottom of the hull 110. A shock strut 123 is connected to one or both support arms 121 such that the support arms 121 are substantially horizontal when the hull 110 is foil-borne in calm water and such that the support arms 121 can pivot about the transverse axis 122 to permit the main foil 120 to move in concert with upgusts and downgusts of water surrounding the main foil 120. In this embodiment, the shock strut 123 is connected to a rigid extension of the support arms 121 which extends from the transverse axis 122 into the hull 10. However, the manner of connecting the shock strut 123 to the support arms 121 is not critical. For example, it can be connected to the support arms 121 at a point between the transverse axis 122 and the main foil 120. As in the previous embodiments, the number of support arms 121 is not critical.

During operation of a hydrofoil craft, forces acting on the foils may apply a rolling moment to the foils. In a hydrofoil craft with an automatic control system, when rolling of the craft is detected, flaps on the foils are automatically adjusted to adjust the lift on the foils and automatically return the hull to a level position. However, automatic control systems and foils with adjustable flaps are complicated and expensive to manufacture.

Figure 19:
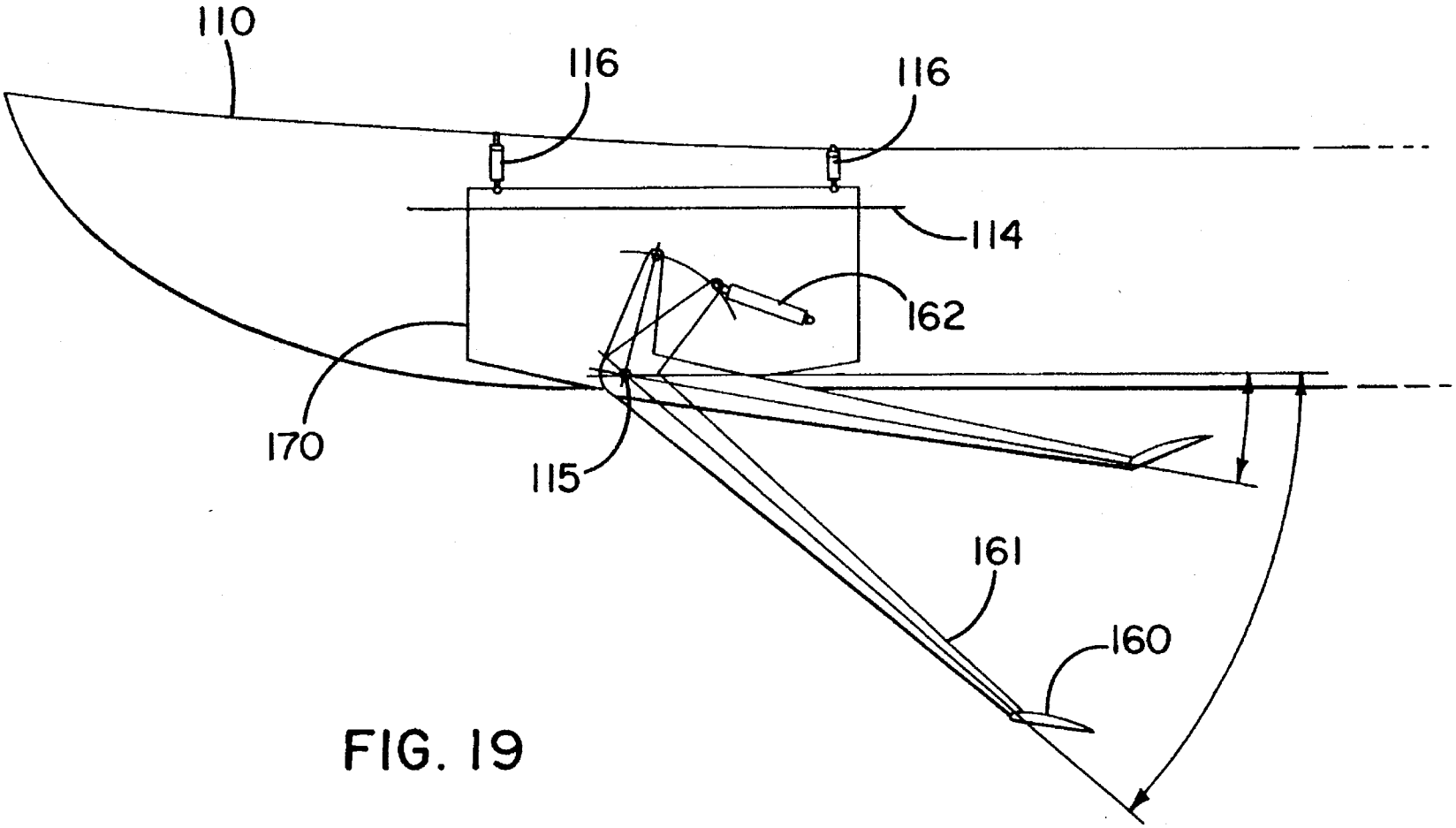
FIG. 19 is a schematic side view of another embodiment of the present invention having laterally pivoting support arms.
Figure 20:
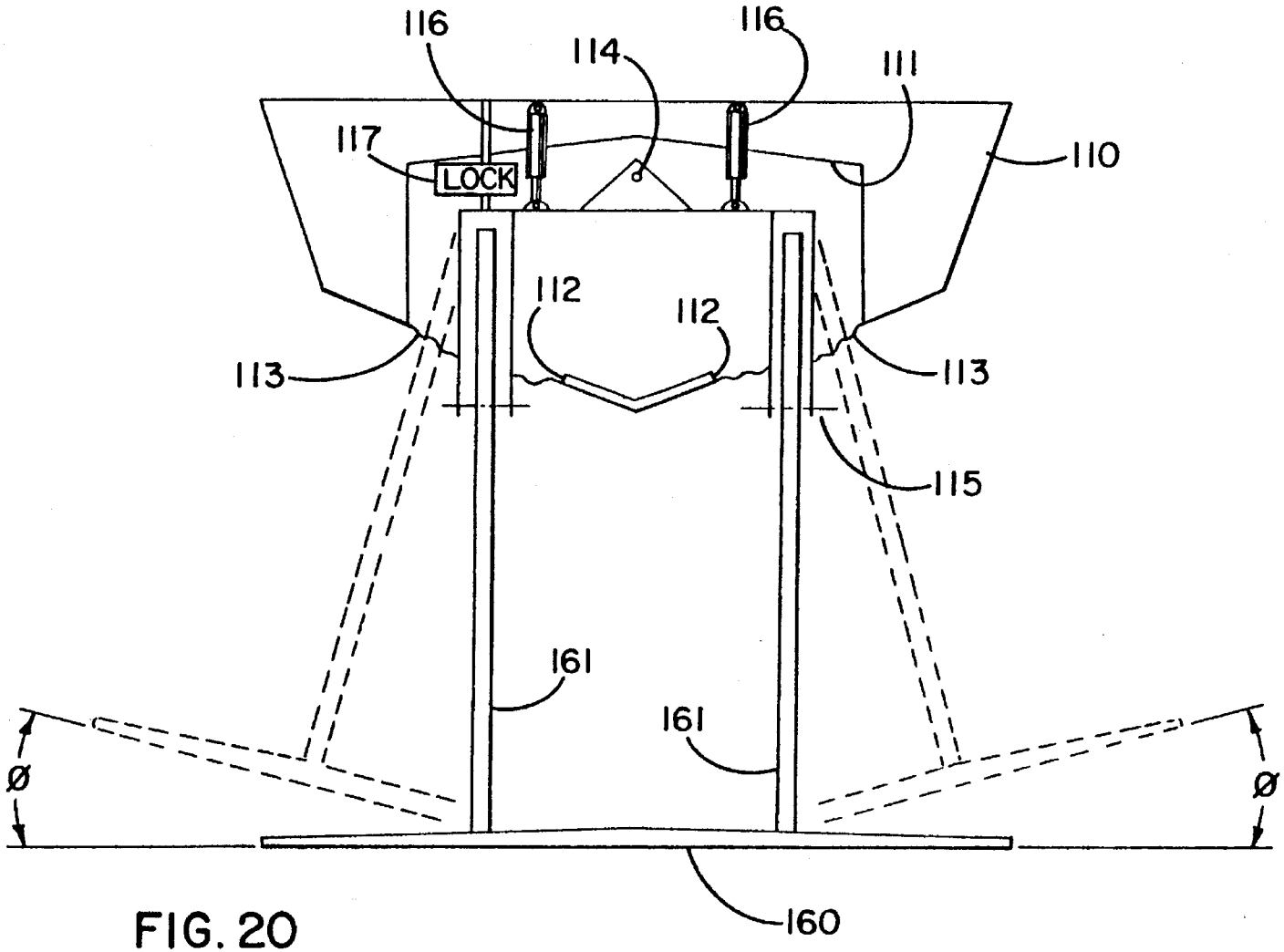
FIG. 20 is a transverse cross-sectional view of the embodiment of FIG. 19.

FIGS. 19 and 20 schematically illustrate an embodiment of a hydrofoil according to the present invention which is able to reduce the effect of rolling forces on the hydrofoil craft with a simple and economical structure. FIG. 19 is a schematic side view of a portion of this embodiment, and FIG. 20 is a schematic transverse cross-sectional view. In this embodiment, one or more support arms 161 for supporting a hull 110 atop a main foil 160 are connected to the hull 110 so that the foil 160 and the support arms 161 can pivot together about an axis 114 extending generally in the longitudinal direction, i.e., the fore and aft direction of the hull 110. This longitudinal axis 114 preferably lies along the centerline plane of the hull 110 and is preferably substantially parallel to the water surface when the hull 110 is foil-borne and operating at its customary trim.

The support arms 161 are connected to a support frame 170 which is pivotably connected to the hull 110 for pivoting about the longitudinal axis 114. The support frame 170 is disposed within a cavity 111 in the hull 110, and the support arms 161 extend through corresponding openings 112 in the bottom surface of the hull 110. In the case of a catamaran vessel with twin hulls, the support frame 170 can be disposed between the hulls. The openings 112 can be equipped with flexible seals 113 attached between the hull 110 and the support frame 170 if it is desired to prevent water from entering into the cavity 111 via the openings 112 during foil-borne operation of the craft.

The support arms 161 can be rigidly connected to the support frame 170, but preferably they are supported such that the foil 160 can move up and down in concert with upgusts and downgusts of water surrounding the foil 160 and thereby maintain the hull 110 at a substantially constant height above the mean water level during foil-borne operation. For example, the support arms 161 can be connected to the support frame 170 so that they can pivot about a transverse axis 115 extending substantially perpendicular to the centerline of the hull 110 and to the longitudinal axis 114. As in the embodiment of FIG. 12, a shock strut 162 is connected between the support frame 170 and the upper ends of one or both support arms 161. Alternatively, shock struts 162 can be connected to the support arms 161 at a point between the transverse axis 115 and the foil 160, as in the embodiment of FIG. 1. Any of the other arrangements disclosed in the preceding embodiments for enabling up and down movement of a foil can also be used.

As shown in FIG. 20, the support frame 170 and the support arms 161 can pivot about the longitudinal axis 114 by up to an angle $\phi$ from a centered position shown by the solid lines in the figure, in which the foil 160 is horizontal and centered with respect to the centerline plane of the hull 100, to either of the positions shown by dashed lines. The value of the angle $\phi$ is not critical, and will depend upon the operating conditions of the vessel. A roll angle of approximately 15 degrees is the greatest that is likely to be encountered in random waves, so in the present embodiment, the supports arms 161 can pivot about the longitudinal axis 114 by up to 15 degrees in each direction from the centered position. The angle of pivoting in either direction from the centered position can be limited by any suitable means, such as by stops attached to the hull 110 or by the edges of the openings 112 in the hull 110.

The center of gravity of the hull 110 can be located either above or below the longitudinal axis 114. If the center of gravity is located below the longitudinal axis 114, the hull 110 will be stably supported without the need for any restraining members connected between the support frame 170 and the hull 110. However, some resilient biasing means is generally desirable to bias the support frame 170 to a central position with respect to the hull 110 and to provide sufficient damping to prevent resonance when the natural frequency of the hull 110 about longitudinal axis 114 coincides with the frequency of waves acting on the craft. An example of a suitable biasing means is one or more shock struts 116 connected between the support frame 170 and the hull 110. The shock struts 116 need not be of any particular type and can be similar to the shock strut 162 connected to the support arms 162. Preferably, the shock struts 116 are adjustable so that their spring constant can be varied in accordance with operating conditions of the hydrofoil craft.

There may be situations in which it is desirable to lock the position of the support frame 170 with respect to the hull 110. The shock struts 116 can be designed so that they can be locked to form a rigid connection between the hull 110 and the support frame 170, or a separate locking mechanism 117 can be provided between the hull 110 and the support frame 170.

FIGS. 19 and 20 illustrate only a single foil 160 for supporting the hull 110. However, the hull 110 may be equipped with a plurality of foils, and each of these foils may be supported in a manner permitting the support arms for each of the foils to pivot about a longitudinal axis.

Figure 21A:
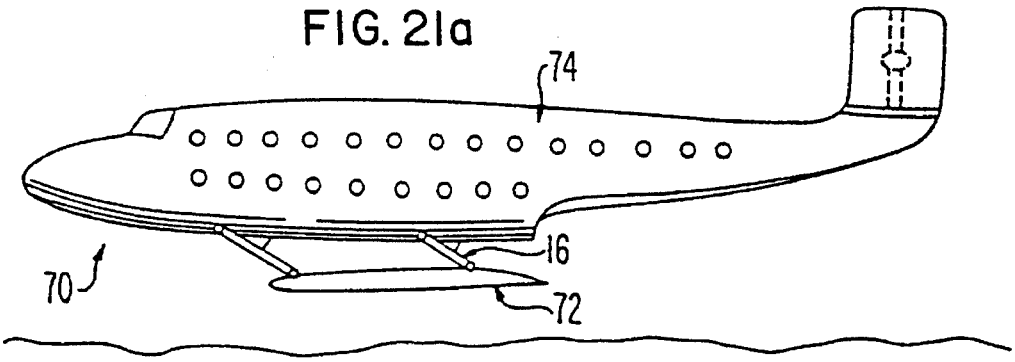
FIGS. 21*a* and 21*b* are side elevational views showing the unique WIG aircraft of the present invention with means for allowing the wings to move in concert with the changes in vertical velocity around the wings, wherein the means which allows movement is a shock strut/support arm/wing system.
Figure 21B:
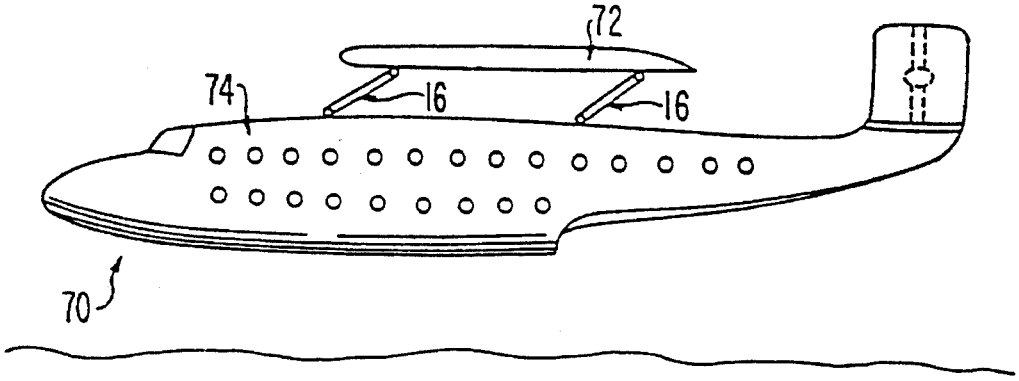
Figure 22A:
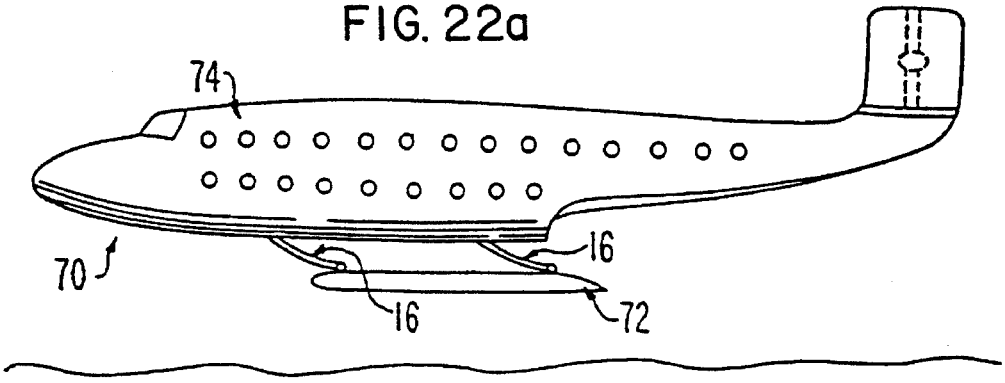
FIGS. 22*a* and 22*b* are side elevational views showing the unique WIG aircraft of the present invention with means for allowing the wings to move in concert with the charges in vertical velocity around the wings, wherein the means which allows movement is a flexible support arm.
Figure 22B:
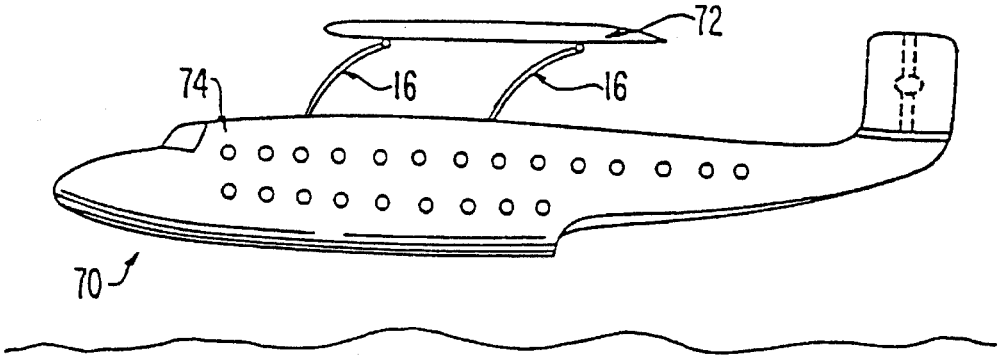
Figure 23A:
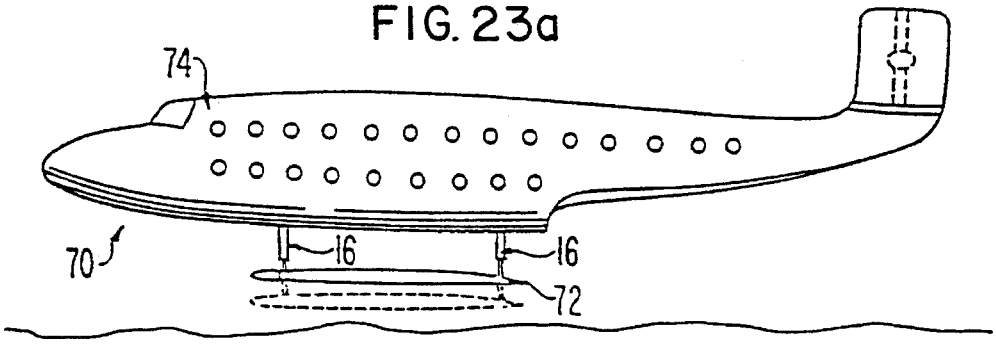
FIGS. 23*a* and 23*b* are side elevational views showing the unique WIG aircraft of the present invention with means for allowing the wings to move in concert with the changes in vertical velocity around the wings, wherein the means which allows movement is a vertical support arm which is telescoping in nature.
Figure 23B:
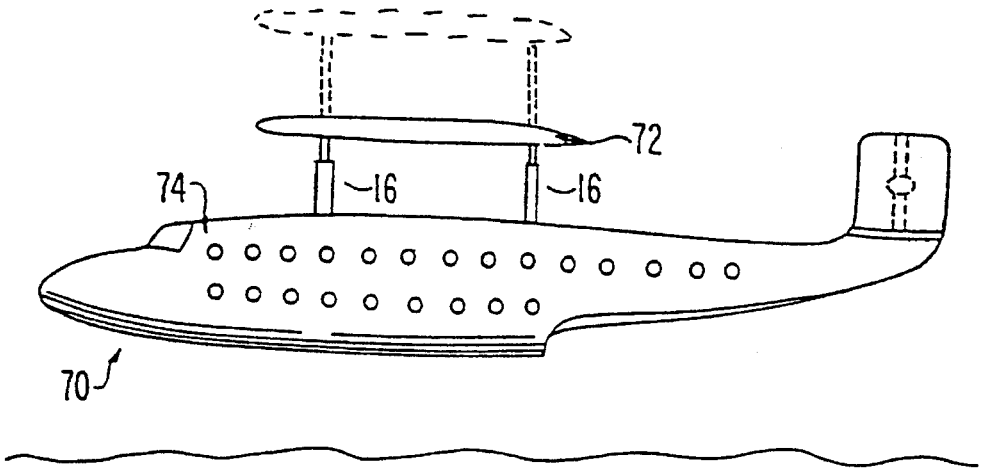

According to another aspect of the present invention, the previously described mobile support arm systems which allow a foil 20 to move in concert with the changes in local vertical water velocity can be equally applied to WIG aircraft 70, as is shown in FIGS. 21–23. The only difference between the mobile support arm systems when they are applied in a WIG 70 and when they are applied in a hydrofoil 10 is that in a WIG 70 the support arm 16 is attached to a wing 72 rather than foil 20. Nonetheless, the same support arm systems can be used in WIGS 70 and hydrofoils 10 because the lift creating sections, i.e. foils 20 and wings 72 function similarly: they both create lift by the angle at which they attack the approaching fluid, i.e., air or water.

Using these support arm systems allows a WIG 70 to maintain approximately constant lift because these support arm systems allow the wing 72 to move in concert with the random changes in lift caused by the proximity of the wing 72 to the water's surface or by head or following winds. Thus, using these support arm systems allows a WIG 70 to fly comfortably and efficiently just above the water's surface. Preferably, two support arms are attached to one wing, as is shown in FIGS. 21–23. Moreover, the support arm 16 can be attached either at or near the bottom of the fuselage 74 or at or near the top of the fuselage 74, as is shown in FIGS. 21–23.

As can be seen, this invention provides a unique method for allowing hydrofoils and WIG craft to operate in or above rough waters at high speeds. Moreover, the hydrofoil craft and WIG craft of the present invention contains a unique system which allows the foils or wings attached to the support arms extending from the main body section (i.e., hull or fuselage) to move in concert with the changes of vertical velocity of the fluid (i.e., water or air) around the foils or wings.

What is claimed is:

1. A hydrofoil craft comprising:

a hull;

a foil for supporting the hull above a water surface;

a support arm having a first end connected to the foil and a second end connected to the hull in a manner enabling the support arm to pivot with respect to the hull in response to rolling forces from a center position about a first axis spaced from the first end and extending in generally a fore and aft direction of the hull and enabling the support arm to pivot with respect to the hull about a second axis spaced from the first end and extending roughly perpendicular to the first axis, whereby the foil can move in concert with upgusts and downgusts in the water surrounding the foil.

2. A hydrofoil craft as claimed in claim 1 wherein the first axis is substantially horizontal when the hull is above the water surface.

3. A hydrofoil craft as claimed in claim 1 wherein the support arm can pivot about the first axis by at least 15 degrees in first and second directions from the center position.

4. A hydrofoil craft as claimed in claim 3 wherein the foil is symmetrically disposed with respect to a centerline plane of the hull when the support arm is in its center position.

5. A hydrofoil craft as claimed in claim 1 wherein the first axis lies in a centerline plane of the hull.

6. A hydrofoil craft as claimed in claim 1 including biasing means for biasing the support arm to its center position.

7. A hydrofoil craft as claimed in claim 6 wherein the biasing means comprises a shock strut coupled between the hull and the support arm.

8. A hydrofoil craft as claimed in claim 1 wherein the foil is without flaps for countering rolling forces.

9. A hydrofoil craft as claimed in claim 1 including a lock for selectively locking the support arm to prevent pivoting of the support arm about the first axis.

10. A hydrofoil craft as claimed in claim 1 wherein each axis passes through the hull.

11. A hydrofoil craft as claimed in claim 1 wherein the foil is connected to the support arm such that the entire foil can swing in an arc about each axis.

12. A hydrofoil craft comprising:

a hull;

a foil for supporting the hull above a water surface;

a frame pivotably supported by the hull for pivoting about the first axis extending in generally a fore and aft direction of the hull; and a support arm connected to the foil and connected to the frame in a manner enabling the support arm to pivot with respect to the hull in response to rolling forces from a center position about the first axis and pivotally supported by the frame for pivoting about a second axis extending roughly perpendicular to the first axis, whereby the foil can move in concert with upgusts and downgusts in the water surrounding the foil.

13. A hydrofoil craft comprising:

a hull;

one or more aft-extending support arms supported by the hull for pivoting about an axis extending transversely with respect to a centerline plane of the hull;

a foil disposed beneath the hull for supporting the hull above a water surface and connected to the one or more support arms such that an angle of incidence of the foil varies as the one or more support arms pivot about the axis, the foil being supported solely by the one or more aft-extending support arms; and biasing means for biasing the one or more support arms to pivot away from the hull, wherein an angle measured downwards from a horizontal line to a line connecting the axis with a quarter chord of the foil when the hull is foil-borne in calm water is at most approximately 60 degrees.

14. A hydrofoil craft as claimed in claim 13 wherein the angle is at most approximately 40 degrees.

15. A hydrofoil craft as claimed in claim 13 wherein the biasing means permits movement of the foil with respect to the hull in concert with upgusts and downgusts of water surrounding the foil between an upper position and a lower position separated by approximately the maximum height of waves in which the craft is designed to operate.

16. A hydrofoil craft as claimed in claim 15 wherein the biasing means exerts a force having a an arbitrary value of 1.0 when the foil is at its mean distance from the hull in calm water, a force having a value of at most approximately 2 when the foil is at the upper position, and a force having a value of at least approximately 0.5 when the foil is at the lower position.

17. A hydrofoil craft as claimed in claim 15 wherein the biasing means exerts a force having a value of at most approximately 1.4 when the foil is at the upper position and a force having a value of at least approximately 0.8 when the foil is at the lower position.

18. A hydrofoil craft as claimed in claim 13 wherein the biasing means comprises a hydraulic shock strut connected between the hull and the one or more support arms.

19. A hydrofoil craft as claimed in claim 13 wherein the foil is pivotably connected to the one or more support arms and can pivot to a position in which the foil is aligned with an axis of the one or more support arms.

20. A hydrofoil craft as claimed in claim 13 further comprising:

a propeller connected to the hull;

a ventilating tube supported by the hull and connecting the atmosphere with a suction side of the propeller when the propeller is submerged and the hull is supported above the water surface by the foil.

21. A hydrofoil craft as claimed in claim 20 further comprising a cowling at least partially surrounding the propeller, the second end of the bore communicating with the inside of the cowling.

22. A hydrofoil craft as claimed in claim 21 further comprising flow control means for controlling a gas flow rate through the bore.

23. A hydrofoil craft as claimed in claim 22 wherein the flow control means comprises a valve disposed in the bore.

24. A hydrofoil craft as claimed in claim 20 further comprising means for raising and lowering the ventilating tube and the propeller with respect to the hull while the propeller is operating.

25. A hydrofoil craft as claimed in claim 13 wherein the support arms are connected to the foil at points equidistant from a leading edge of the foil.

26. A hydrofoil craft as claimed in claim 13 wherein the support arms are connected to the foil adjoining a leading edge of the foil.

27. A hydrofoil craft as claimed in claim 13 wherein the hydrofoil craft is a submerged-foil hydrofoil craft.

28. A hydrofoil craft as claimed in claim 13 wherein the foil is rigidly connected to the support arms.

29. A hydrofoil craft as claimed in claim 13 wherein the foil is rotatably connected to the support arms, each support arm including a stopper limiting upward rotation of the foil about the support arm while permitting downward rotation of the foil to a position in which the foil is feathered with respect to the support arms.

30. A hydrofoil craft as claimed in claim 29 wherein each stopper comprises an arm extending over an upper surface of the foil.

31. A hydrofoil craft comprising:

a hull;

a support arm disposed beneath the hull and supported by the hull for pivoting about an axis extending transversely with respect to a centerline plane of the hull;

a lift generating foil connected to the support arm below the hull; and a biasing member connected to the support arm for exerting a biasing force on the support arm to maintain the support arm substantially horizontal when the hull is raised above the water surface in calm water and permitting pivoting movement of the support arm about the axis to enable the foil to move up and down with respect to the hull in concert with upgusts and downgusts of water surrounding the foil.

32. A hydrofoil craft as claimed in claim 31 comprising a rigid strut having an upper end supported by the hull and a lower end extending downwards from the hull, wherein the support arm is supported by the lower end of the strut for pivoting about the axis.

33. A hydrofoil craft comprising:

a hull;

a foil connected to the hull for supporting the hull above a water surface;

a propeller supported by the hull; and a ventilating tube connecting the atmosphere with a suction side of the propeller when the propeller is submerged and the hull is supported above the water surface by the foil.

34. A hydrofoil craft according to claim 33 including a cowling surrounding an upper portion of the propeller and open to the water along a lower portion of the propeller.

35. A hydrofoil craft according to claim 34 wherein the cowling is open to the water over approximately a lower half of the propeller.

36. A hydrofoil craft according to claim 33 wherein air flow through the bore is such that approximately an upper half of the propeller disc is operating in air supplied through the ventilating tube while approximately a lower half of the propeller disc is operating in water.

37. A hydrofoil craft according to claim 36 including a valve mounted on the ventilating tube for adjusting an air flow rate through the bore, and a control unit controlling the valve in accordance with a speed of the craft.

38. A hydrofoil craft according to claim 37 wherein the control unit controls the valve such that air is introduced to the suction side of the propeller at a rate of approximately 0.5 VAp wherein V is a speed of the hull and Ap is the swept area of the propeller disc.

39. A hydrofoil craft comprising:

a hull having a longitudinal centerline plane;

a first foil and a Second foil each extending transversely with respect to the centerline plane;

a first support arm connected between the hull and the first foil; and a second support arm connected between the hull and the second foil for supporting the second foil in a submerged position with respect to a water surface, the first support arm being movable independently of the second support arm, while the hull is moving and raised above the water surface, between a lowered position in which the first foil is totally submerged and in close proximity to the second foil and the first and second foils overlap in a longitudinal direction of the hull, and a raised position in which the first foil is raised above the water surface and the second foil is totally submerged.

40. A hydrofoil craft as claimed in claim 27 wherein the first support arm is movable between the raised and lowered position by pivoting of the first support arm about an axis extending in a transverse direction of the hull.

41. A hydrofoil craft comprising:

a hull having a longitudinal centerline plane;

a first foil and a second foil each extending transversely with respect to the centerline plane;

a first support arm connected between the hull and the first foil;

a second support arm connected between the hull and the second foil for supporting the second foil in a submerged position with respect to a water surface; and movement enabling means for enabling the second support arm and the second foil to move in concert with upgusts and downgusts of water located around the second foil so that the hull maintains an approximately constant elevation above the water, the first support arm being movable independently of the second support arm, while the hull is moving and raised above the water surface, between a lowered position in which the first foil is submerged and in close proximity to the second foil and a raised position in which the first foil is raised above the water surface and the second foil is submerged.

42. The hydrofoil craft of claim 41 wherein the movement enabling means comprises a shock strut connected between the second support arm and the hull.

43. A method of operating a hydrofoil craft comprising:

supporting a moving hull above a water surface by a first totally submerged foil and a second totally submerged foil disposed in close proximity to one another beneath the water surface when the speed of the hull is in a first speed range; and raising the first foil with respect to the second foil to above the water surface by pivoting a support arm for the first foil about an axis extending in a transverse direction of the hull and supporting the hull with the second foil when the speed is in a second speed range higher than the first speed range.

44. The method of claim 43 wherein the first foil has a larger surface area than the second foil.

45. The method of claim 43 including the step of overlapping the first and second foils with respect to each other in a longitudinal direction of the hull in the first speed range.

46. The method of claim 43 wherein raising the first foil comprises moving the first foil along an arc in an aft direction of the hull.

47. A method of operating a hydrofoil craft comprising:

propelling a moving hull with a propeller disposed beneath a water surface and the hull supported above the water surface by a foil; and simultaneously introducing air through a conduit from the atmosphere to a suction side of the propeller at a rate such that an upper portion of the propeller is operating entirely in air introduced through the conduit while a lower portion is operating entirely in water.

48. A method according to claim 47 including introducing air at a rate such that approximately an upper half of the propeller disc is operating in air introduced through the conduit while approximately a lower half of the propeller disc is operating in water.

49. A method according to claim 47 including introducing the air through the conduit at below one-quarter the speed of sound in air.

50. A method according to claim 47 including introducing air at a rate of approximately 0.5 VAp wherein V is a speed of the hull and Ap is a swept area of the propeller disc.

51. A method according to claim 47 wherein air is introduced into the conduit employing primarily suction generated by the propeller.

52. A hydrofoil craft comprising:

a hull;

a foil for supporting the hull above a water surface;

a propeller connected to the hull;

a passage for air communicating between the atmosphere and a suction side of the propeller;

a valve disposed in the passage for adjusting an air flow rate through the passage; and a controller controlling the valve in accordance with a speed of the hull such that approximately an upper half of the propeller operates in air and approximately a lower half of the propeller operates in water with the propeller submerged.

53. A hydrofoil craft according to claim 52 wherein the controller controls the valve such that approximately the upper half of the propeller operates in air and approximately the lower half of the propeller operates in water with the propeller submerged when the hull is supported above the water surface by the foil.

54. A hydrofoil craft comprising:

a hull having a longitudinal centerline plane;

a first foil and a second foil each extending transversely with respect to the centerline plane;

a first support arm connected between the hull and the first foil; and a second support arm connected between the hull and the second foil for supporting the second foil in contact with a body of water so that the second foil generates lift, the first support arm being movable independently of the second support arm, while the hull is moving and raised above a water surface of the body of water, by pivoting about an axis extending in a transverse direction of the hull, between a lowered position in which the first foil is in close proximity to the second foil and in contact with the body of water so as to generate lift and a raised position in which the first foil is raised above the water surface and the second foil is contacting the body of water.

55. A hydrofoil craft as claimed in claim 54 wherein the first foil is rotatably connected to the first support arm so that the first foil points into relative water flow as the first support arm is being raised.

56. A hydrofoil craft as claimed in claim 54 wherein the first and second foils overlap each other in a longitudinal direction of the hull when the first support arm is in its lowered position.

57. The hydrofoil craft of claim 56 wherein the first foil has an opening which receives the second support arm when the first support arm is in its lowered position.

58. The hydrofoil craft of claim 57 wherein the opening is formed in a leading edge of the first foil.

59. The hydrofoil craft of claim 54 wherein the first foil is totally submerged in its lowered position.

60. The hydrofoil craft of claim 59 wherein the first foil has a larger surface area than the second foil.

61. The hydrofoil craft of claim 59 wherein the first foil is a subcavitating foil and the second foil is a supercavitating foil.

62. A method of operating a hydrofoil craft comprising:

supporting a moving hull above a water surface by a first totally submerged foil and a second totally submerged foil disposed in close proximity to one another beneath the water surface and overlapping one another in a longitudinal direction of the hull when the speed of the hull is in a first speed range; and raising the first foil with respect to the second foil to above the water surface and supporting the hull with the second foil when the speed is in a second speed range higher than the first speed range.

* * * * *

UNITED STATES PATENT AND TRADEMARK OFFICE

CERTIFICATE OF CORRECTION

PATENT NO. : 5,469,801

DATED : November 28, 1995

INVENTOR(S) : Payne

It is certified that error appears in the above-indentified patent and that said Letters Patent is hereby corrected as shown below:

Column 23, Line 19, change "Second" to --second--;

Line 36, change "27" to --39--.

Signed and Sealed this

Twenty-fifth Day of June, 1996

Bruce Lehman

*Attest:*

BRUCE LEHMAN

*Attesting Officer*

*Commissioner of Patents and Trademarks*